US006109728A

United States Patent [19]

Kakuda et al.

[11] Patent Number: 6,109,728

[45] **Date of Patent: *Aug. 29, 2000**

[54] INK JET PRINTING HEAD AND ITS PRODUCTION METHOD

[75] Inventors: Shinichi Kakuda, Yokohama; Yoshihisa Ohta, Machida, both of Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,283

[22] Filed: Sep. 11, 1996

[30] Foreign Application Priority Data

Sep. 14, 1995 [JP] Japan ..... 7-236261

[51] Int. Cl.[7] ..... B41J 2/135

[52] U.S. Cl. ..... 347/45

[58] Field of Search ..... 347/45, 47

[56] References Cited

U.S. PATENT DOCUMENTS

| | | | |
|---|---|---|---|
| 4,528,070 | 7/1985 | Gamblin | 204/11 |
| 4,733,447 | 3/1988 | Ageishi | 29/157 C |
| 4,947,184 | 8/1990 | Moynihan | 347/45 |
| 5,443,687 | 8/1995 | Koyama et al. | 216/27 |
| 5,759,421 | 6/1998 | Takemoto et al. | 216/27 |
| 5,838,347 | 11/1998 | Inamoto et al. | 347/45 |

FOREIGN PATENT DOCUMENTS

| | | | |
|---|---|---|---|
| 55-65564 | 5/1980 | Japan | B41J 3/04 |
| 56-89569 | 7/1981 | Japan | B41J 3/04 |
| 63-3963 | 1/1988 | Japan | B41J 3/04 |
| 187359 | 3/1989 | Japan | B41J 3/04 |
| 1-280566 | 11/1989 | Japan . | |
| 239944 | 2/1990 | Japan | B41J 2/045 |
| 4294145 | 10/1992 | Japan | B41J 2/045 |

*Primary Examiner*—John Barlow
*Assistant Examiner*—C. Dickens
*Attorney, Agent, or Firm*—Cooper & Dunham LLP

[57] ABSTRACT

An ink jet printing head includes a nozzle plate having an outside surface and a plurality of nozzles for discharging ink from the outside surface, each nozzle having a first diameter at a peripheral edge of the nozzle plate. A surface treatment layer is provided on the outside surface of the nozzle plate, the surface treatment layer having a plurality of openings overlapping the plurality of nozzles, each opening having a second diameter at a peripheral edge of the surface treatment layer, the second diameter being smaller than the first diameter.

13 Claims, 21 Drawing Sheets

LAMINATE

EXPOSURE

DEVELOP

LAMINATE

EXPOSURE

ULTRAVIOLET LIGHT

DEVELOP

SURFACE TREATMENT

REMOVE

EXPOSING QUANTITY:GREAT
DEVELOPING TIME:SHORT

EXPOSING QUANTITY:SMALL
DEVELOPING TIME:LONG

LAMINATE

LAMINATE

EXPOSURE

ULTRAVIOLET LIGHT

DEVELOP

SURFACE TREATMENT

REMOVE

COAT PHOTOSENSITIVE RESIN

ULTRAVIOLET LIGHT

EXPOSURE

HEAT

LAMINATE

LAMINATE

EXPOSURE
ULTRAVIOLET LIGHT
52
41
45
42
48
51

52
41
49
42
48
51

DEVELOP
51
41
42
50
52

DEVELOP
50a
41
42
50
52

SURFACE TREATMENT
50a
41
43
42
50
52

REMOVE
43a
43
42
42a
41

LAMINATE

LAMINATE

EXPOSURE

ULTRAVIOLET LIGHT

DEVELOP

SURFACE TREATMENT

REMOVAL

INK JET PRINTING HEAD AND ITS PRODUCTION METHOD

BACKGROUND OF THE INVENTION (1) Field of the Invention

The present invention generally relates to an ink jet printing head and a method of producing the ink jet printing head. More particularly, the present invention relates to an ink jet printing head having a nozzle plate with a plurality of nozzles for discharging ink by stressing the ink through actuation of piezoelectric elements, and to a method of producing the ink jet printing head.

(2) Description of the Related Art

An ink jet printing head is capable of printing an image on plain recording paper without contacting the printing head with the recording paper. The ink jet printing method is a simple printing process that can be performed, and it can be easily applied to color image printing. A special attention has been paid to the ink jet printing method.

In recent years, an on-demand ink jet printer system in which ink is forced out to the recording paper by an ink jet printing head in accordance with a print signal has become popular. There are two types of the on-demand ink jet printer systems: a thermal jet type and a piezoelectric actuation type. Concerning the two types of the on-demand ink jet printer systems, the disclosure of U.S. patent application Ser. No. 517,719 filed on Aug. 21, 1995, which is assigned to the assignee of the present invention, is herein incorporated by reference.

Generally, the ink jet printing head includes a nozzle plate with a plurality of nozzles for discharging ink to the recording paper, and an energy generating part for generating energy in accordance with a print signal. The energy generated by the energy generating part stresses the ink within the ink jet printing head so that the ink is discharged from the nozzles. It is known that the application of a surface treatment to the nozzle plate to form a water-repellent layer on the outer surface of the nozzle plate is effective to stabilize a discharge of ink from the nozzle.

More specifically, in order to provide a stable, constant discharge of ink from the nozzle of the ink jet printing head, it is necessary to efficiently transmit the energy from the energy generating part to the ink. If no water-repellent layer on the nozzle plate is formed, the ink coming out from the nozzle tends to stick to the outer surface of the nozzle plate adjacent to the nozzle when it is discharged. The water-repellent layer on the outer surface of the nozzle plate helps provide an efficient transmission of the energy to the ink.

Various surface treatments for the ink jet printing head which are intended to provide a stable, constant discharge of ink from the nozzle are known.

Japanese Laid-Open Patent Application No. 55-65564 teaches a water-repellent surface treatment applied to an orifice-surrounding surface of a printing head. For the water-repellent surface treatment, a silicon-containing water-repellent agent or a fluorine-containing water-repellent agent is applied to the orifice-surrounding surface to form a water-repellent layer thereon.

Japanese Laid-Open Patent Application No. 56-89569 teaches a water-repellent surface treatment applied to an orifice-surrounding surface of a printing head. For the surface treatment, a special fluorine-containing organic silane compound is used to form a water-repellent surface thereon.

Japanese Laid-Open Patent Application No. 64-87359 teaches a plasma-polymerized high-molecular layer formed on an orifice-surrounding end surface of an ink jet printing head. For such a surface treatment, a fluorine-containing compound or a silicon-containing compound is used to form the layer thereon.

Japanese Laid-Open Patent Application No. 2-39944 teaches a water-repellent surface treatment applied to an orifice-surrounding surface of an ink jet printing head. For the surface treatment, a special fluorine-silicon-containing compound is used.

Japanese Laid-Open Patent Application No. 63-3963 teaches a water-repellent layer formed on a nozzle plate of an ink jet printing head. The water-repellent layer is formed through fluorine-containing high-molecular compound eutectoid plating.

Japanese Laid-Open Patent Application No. 4-294145 teaches a water-repellent layer formed on a nozzle-surrounding surface of an ink jet printing head. The water-repellent layer is formed through fluorine-containing high-molecular compound eutectoid plating.

The conventional methods of forming the surface treatment layer using the above-mentioned surface treatments may be classified into two categories: the forming of the surface treatment layer by vacuum evaporation or the like after the forming of the nozzles in the nozzle plate is completed; and the forming of the nozzles in the nozzle plate by punching or the like after the forming of the surface treatment layer is completed.

FIG. 1 shows a surface treated nozzle plate 102 in the case of a conventional ink jet printing head which is produced by using the latter method (the punching to form a nozzle 103 in the nozzle plate 102 is performed after the surface treatment layer 101 is formed).

FIG. 2 shows another surface treated nozzle plate 101 in the case of another conventional ink jet printing head which is produced by using the former method (the surface treatment layer 101 is formed after the nozzle 103 in the nozzle plate 102 is formed).

In both cases, the surface treatment layer 101 has, as shown in FIGS. 1 and 2, an opening whose diameter at a peripheral edge 101*a* of the surface treatment layer 101 is greater than or equal to an inside diameter of the nozzle 103 at a peripheral edge 102*a* of the nozzle plate 102. Since the diameter of the opening of the surface treatment layer 101 is greater than or equal to the diameter of the nozzle 103 at the peripheral edge 102*a* of the nozzle plate 102, the ink coming out from the nozzle 103 tends to stick to the outer surface of the nozzle plate 102 adjacent to the nozzle 103 when it is discharged. Therefore, it is difficult for the conventional ink jet printing head to efficiently transmit the energy from the energy generating part to the ink when it is discharged.

Accordingly, there is a problem in that the efficiency of the discharging of ink of the conventional ink jet printing head is lowered, and that the discharging characteristic of the conventional ink jet printing head becomes unstable. Further, it is difficult for the conventional ink jet printing head to provide a stable, constant discharge of ink because of the relatively great inside diameter of the opening of the surface treatment layer 101.

SUMMARY OF THE INVENTION

An object of the present invention is to provide an improved ink jet printing head in which the above-described problems are eliminated.

Another object of the present invention is to provide an ink jet printing head which efficiently transmits the energy from the energy generating part to the ink when it is discharged, and provides a stable, constant discharge of the ink.

Still another object of the present invention is to provide an ink jet printing head production method which easily and efficiently produces an ink jet printing head for providing a stable, constant discharge of ink.

The above-mentioned objects of the present invention are achieved by an ink jet printing head which comprises: a nozzle plate having an outside surface and a plurality of nozzles for discharging ink from the outside surface, each nozzle having a first diameter at a peripheral edge of the nozzle plate; and a surface treatment layer provided on the outside surface of the nozzle plate, the surface treatment layer having a plurality of openings overlapping the plurality of nozzles, each opening having a second diameter at a peripheral edge of the surface treatment layer, the second diameter being smaller than the first diameter.

The above-mentioned objects of the present invention are achieved by a method of producing an ink jet printing head which comprises the steps of: forming a nozzle plate having an inside surface, an outside surface, and a plurality of nozzles for discharging ink from the outside surface, each nozzle having a first diameter at a peripheral edge of the nozzle plate on the outside surface; laminating a negative dry film resist to the inside surface of the nozzle plate, the dry film resist having a plurality of projecting portions projecting from the nozzles beyond the outside surface; exposing the dry film resist on the inside surface of the nozzle plate to ultraviolet light so that the dry film resist and the projecting portions are cured; developing the dry film resist so that a dry film resist pattern including the cured projecting portions on the nozzle plate is formed; surface treating the nozzle plate so that a surface treatment layer on the outside surface of the nozzle plate is formed, the surface treatment layer having a plurality of openings overlapping the nozzles, each opening having a second diameter at a peripheral edge of the surface treatment layer, the second diameter being smaller than the first diameter; and removing the dry film resist pattern from the nozzle plate, thus producing an ink jet printing head including the nozzle plate and the surface treatment layer.

The ink jet printing head of the present invention can efficiently transmit the energy to the ink when the ink is discharged and provide a stable, constant discharge of ink. It is possible for the ink jet printing head of the present invention to produce an image with increased picture quality. Further, the ink jet printing head production method of the present invention can easily and efficiently produces an ink jet printing head for providing a stable, constant discharge of ink.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

Figure 1:
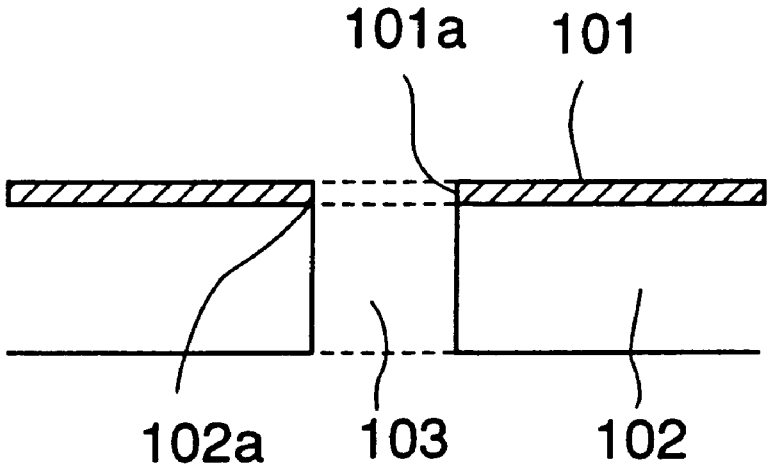
FIG.1 PRIOR ART
FIG. 1 is a cross-sectional view of a conventional surface treated nozzle plate.
Figure 2:
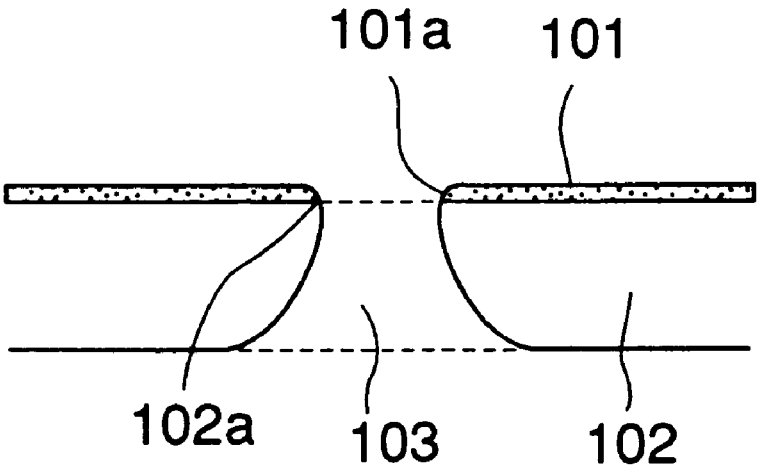
FIG.2 PRIOR ART
FIG. 2 is a cross-sectional view of another conventional surface treated nozzle plate.
Figure 3:
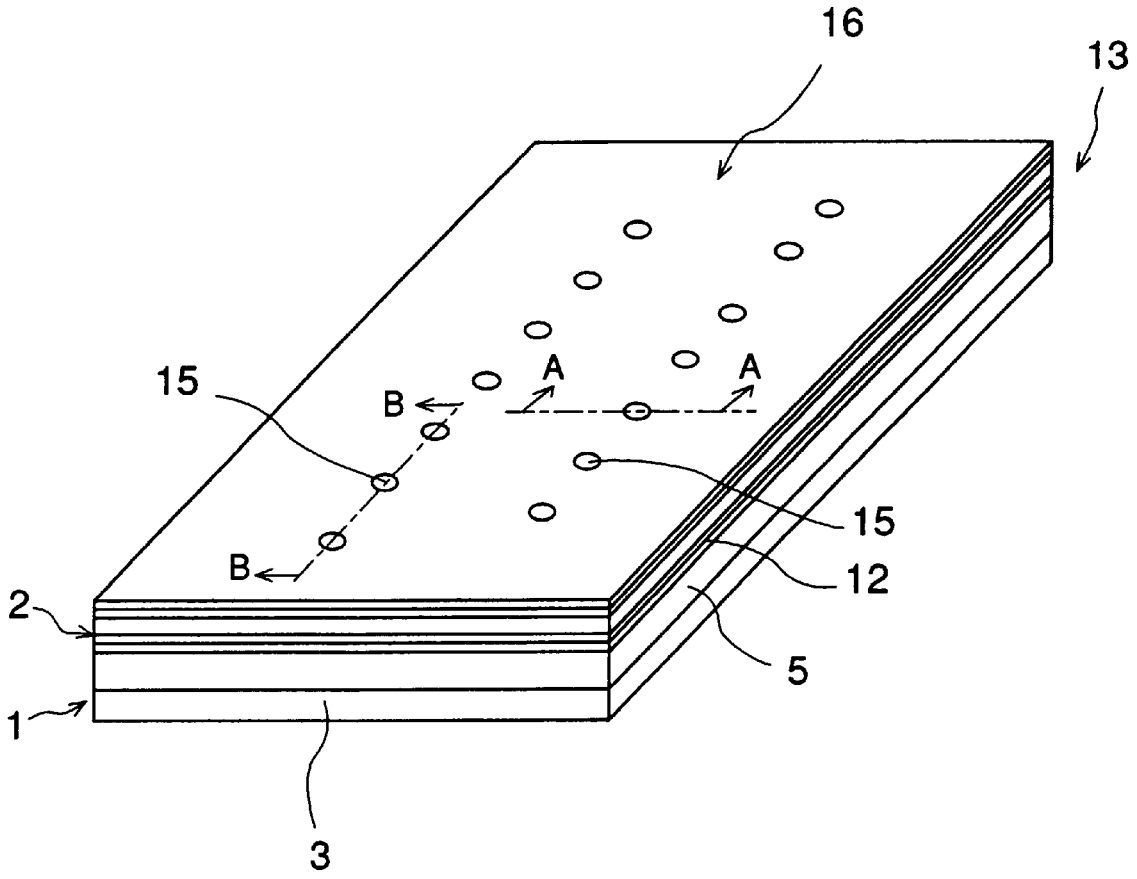
FIG. 3 is a perspective view of an ink jet printing head to which the present invention is applied.
Figure 4:
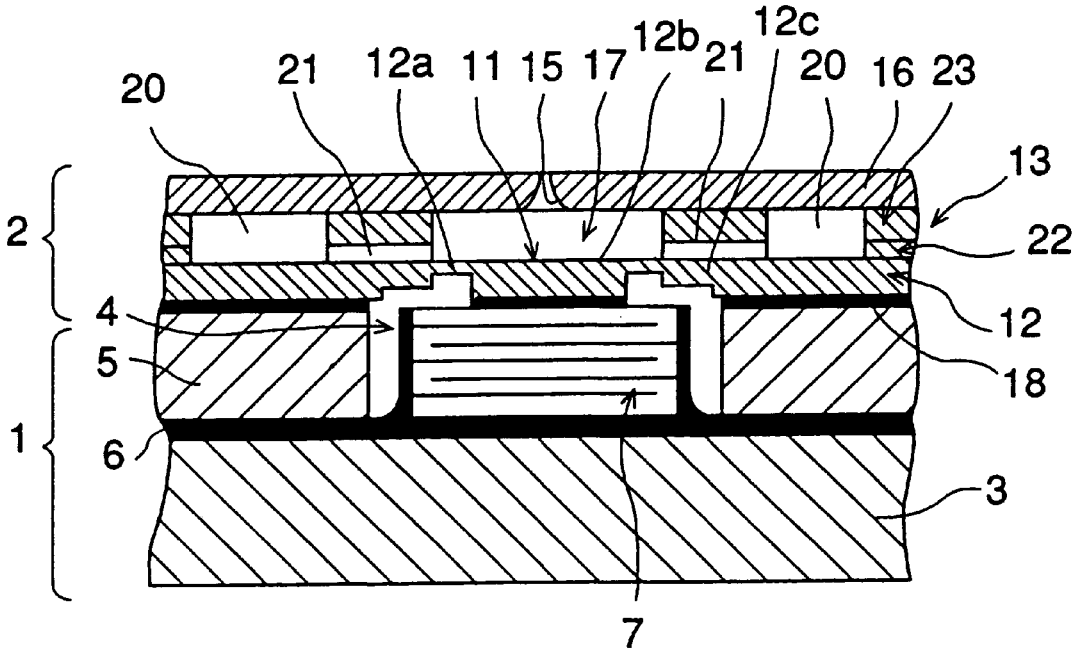
FIG. 4 is a cross-sectional view of the ink jet printing head taken along a line A—A indicated in FIG. 3.
Figure 5:
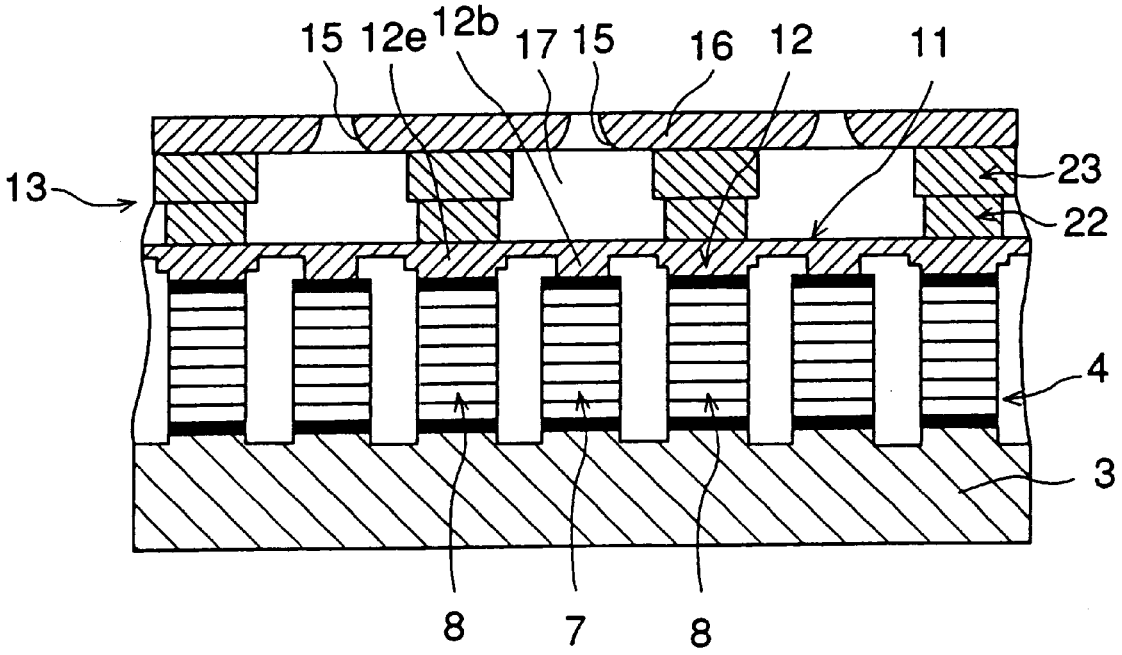
FIG. 5 is a cross-sectional view of the ink jet printing head taken along a line B—B indicated in FIG. 3.

FIG. 3 shows an ink jet printing head to which the present invention is applied. FIG. 4 is a cross-sectional view of the ink jet printing head taken along a line A—A indicated in FIG. 3. A direction in parallel with the line A—A indicated in FIG. 3 will be referred to as a lateral direction of the ink jet printing head. FIG. 5 is a cross-sectional view of the ink jet printing head taken along a line B—B indicated in FIG. 3. A direction in parallel with the line B—B indicated in FIG. 3 will be referred to as a longitudinal direction of the ink jet printing head.

As shown in FIGS. 3, 4 and 5, the ink jet printing head includes an actuator unit 1 and an ink chamber unit 2 bonded onto the actuator unit 1.

The actuator unit 1 includes an insulating substrate 3, two rows of piezoelectric actuators 4 provided on the substrate 3, and a frame 5 surrounding the piezoelectric actuators 4 and provided on the substrate 3. As shown in FIG. 4, the piezoelectric actuators 4 and the frame 5 are bonded onto the substrate 3 by using an adhesive agent. A layer of this adhesive agent is designated by reference numeral 6. The frame 5 has two longitudinally extending openings, and the two rows of the piezoelectric actuators 4 are encircled by the openings of the frame 5 respectively.

As shown in FIG. 5, the piezoelectric actuators 4 of each row includes actuatable piezoelectric elements 7 and fixing piezoelectric elements 8. In each row of the piezoelectric actuators 4, the actuatable piezoelectric elements 7 and the fixing piezoelectric elements 8 are alternately arrayed on the substrate 3 in the longitudinal direction of the ink jet printing head.

A print signal from a print controller (not shown) is supplied to the actuatable piezoelectric elements 7, and each actuatable piezoelectric element 7 is actuated in accordance with the print signal, so that the ink is stressed by the actuatable piezoelectric element 7 and discharged from the nozzle. No print signal is supplied to the fixing piezoelectric elements 8, and the fixing piezoelectric elements 8 are not actuated. The fixing piezoelectric elements 8 are fixed to the substrate 3 and always serve to fix the ink chamber unit 2 to the substrate 3.

As shown in FIGS. 4 and 5, the actuatable piezoelectric elements 7 are elongated in the lateral direction of the ink jet printing head, and they have a relatively small width in the longitudinal direction of the ink jet printing head.

The ink chamber unit 2 forms a plurality of ink chambers 17 within the ink jet printing head. The ink chamber unit 2 includes an oscillation plate 12, an ink passage member 13 bonded to the oscillation plate 12, and a nozzle plate 16 bonded to the ink passage member 13.

The oscillation plate 12 includes a plurality of diaphragm portions 11 which are independently subjected to deformation when the actuatable piezoelectric elements are actuated in accordance with the print signals.

The ink passage member 13 has two layers which are prepared by using photosensitive resin (which is called a dry film resist). The ink passage member 13 forms a plurality of ink passages whose shape corresponds to the shape of the diaphragm portions 11.

The nozzle plate 16 has a plurality of nozzles 15 which are located above the ink chambers 17 respectively.

The ink chambers 17 within the ink jet printing head are formed by the oscillation plate 12, the ink passage member 13, and the nozzle plate 16. The nozzles 15 in the nozzle plate 16 are located above the centers of the ink chambers 17 where the actuatable piezoelectric elements 7 are connected to the diaphragm portions 11 beneath the ink chambers 17.

The oscillation plate 12 on the lower surface of the ink chamber unit 2 is bonded to the top surface of the actuator unit 1 by using an adhesive agent. A layer of this adhesive agent is designated by reference numeral 18. Corresponding portions of the oscillation plate 12 are bonded to the actuatable piezoelectric elements 7, the fixing piezoelectric elements 8 and the frame 5. The bonding of the oscillation plate 12 to the actuator unit 1 by the adhesive agent 18 provides a high rigidity of the ink jet printing head.

The oscillation plate 12 has, as shown in FIG. 4, a flat surface on the side of the ink passage member 13. The oscillation plate 12 includes diaphragm areas 12*a*, bonded areas 12*b*, and relief areas 12*c* on the side of the actuator unit 1. The diaphragm areas 12*a*, the bonded areas 12*b* and the relief areas 12*c* have thicknesses which are different from each other. The diaphragm portions 11 are formed by these areas of the oscillation plate 12 having different thicknesses, and the diaphragm portions 11 are bonded to the actuatable piezoelectric elements 7 by the adhesive agent 18.

The diaphragm areas 12*a* have the smallest thickness among the thicknesses of the areas 12*a*, 12*b* and 12*c* of the oscillation plate 12. The diaphragm portions 11 with a thickness in the range of 3 $\mu$m to 10 $\mu$m are primarily formed by the diaphragm areas 12*a*, and the diaphragm areas 12*a* are subjected to resilient deformation when the actuatable piezoelectric elements 7 are actuated in accordance with the print signal. The bonded areas 12*b* have the greatest thickness among the thicknesses of all the areas of the oscillation plate 12. By means of the bonded areas 12*b*, the oscillation plate 12 is bonded to the actuatable piezoelectric elements 7, the fixing piezoelectric elements 8 and the frame 5. The bonded areas 12*b* of the oscillation plate 12 are 20 $\mu$m thick or greater.

The oscillation plate 12 includes, as shown in FIG. 5, beam areas 12*e* which are included in the bonded areas 12*b*. By means of the beam areas 12*e*, the ink chamber unit 2 is bonded to the fixing piezoelectric elements 8. The relief areas 12*c* have an intermediate thickness between the smallest thickness of the diaphragm areas 12*a* and the greatest thickness of the bonded areas 12*b*. The relief areas 12*c* are provided to prevent the diaphragm areas 12*a* from directly contacting the actuatable piezoelectric elements 7 when the oscillation plate 12 is subjected to oscillations.

The oscillation plate 12 is made of a material which meets the following requirements: it provides elasticity to transfer the deformation of each piezoelectric element to a corresponding ink chamber; it is well resistant to ink or the liquid; and it is less moisture permeable. In order for the oscillation plate 12 bonded to the fixing piezoelectric elements 8 to provide a high rigidity of the head, it is preferable that Young's modulus of the material of the oscillation plate 12 is greater than 100 kg/mm$^2$.

In the present embodiment, the oscillation plate 12 is made of a thin sheet of nickel (Ni). The oscillation plate 12 is prepared through electroforming by using a thin sheet of nickel. Alternatively, the oscillation plate 12 may be made of a thin stainless steel sheet or a thin resin sheet having a small moisture permeability. Examples of the thin resin sheet for the oscillation plate 12 are: resin materials of polyphenylene sulfide, polyimide, polyester sulfone, polychlorotrifluoroethylene, and aramido.

As shown in FIGS. 4 and 5, the ink passage member 13 is arranged between the oscillation plate 12 and the nozzle plate 16. The ink passage member 13 includes the ink passages which communicates with the ink chambers 17 within the ink jet printing head.

As described above, the ink passage member 13 includes two layers which are prepared by using the dry film resist (the photosensitive resin material). The two layers of the ink passage member 13 are a lower ink passage layer 22 and an upper ink passage layer 23, as shown in FIGS. 4 and 5. The lower ink passage layer 22 is prepared by forming a predetermined ink passage pattern on the oscillation plate 12 by using the dry film resist. The upper ink passage layer 23 is prepared by forming a predetermined ink passage pattern by using the dry film resist. These layers 22 and 23 are laminated or bonded to form the ink passage member 13.

The ink passage member 13 forms common ink chambers 20 arranged on both sides of a plurality of ink chambers 17 to supply ink to the ink chambers 17. Further, the ink passage member 13 forms a plurality of ink supply passages 21 arranged between the ink chambers 17 and the common ink chambers 20. The ink chambers 17 and the common ink chambers 20 communicate with each other via the ink supply passages 21. The ink supply passages 21 are formed in the lower ink passage layer 22. The ink supply passages 21 serve as fluid resistance portions within the ink jet printing head.

In the present embodiment, the ink passage member 13 has a two-layer structure. However, it is possible to modify the present embodiment so that the ink passage member 13 has a multiple-layer structure including three or more layers. In addition, the ink passage member 13 is made of the photosensitive resin material (the dry film resist). However, it is possible to modify the present embodiment so that the ink passage member 13 is made of a thin sheet of nickel (Ni), silicon (Si) or the like.

The nozzle plate 16 includes the plurality of nozzles 15 for discharging ink when the actuatable piezoelectric elements are actuated in accordance with the print signals. The inside diameter of each nozzle 15 at the peripheral edge of the nozzle plate 16 is formed to be below 35 $\mu$m.

Similarly to the oscillation plate 12, the nozzle plate 16 in the present embodiment is made of a thin sheet of nickel (Ni). The nozzle plate 16 is prepared through electroforming by using a thin sheet of nickel. Alternatively, the nozzle plate 16 may be made of a thin sheet of silicon (Si) or the like. In the case of an ink jet printing head for practical use, the ink jet printing head is designed such that it has a nozzle plate including a total of 64 through 128 nozzles arranged in two rows in parallel with the longitudinal direction of the ink jet printing head. The structure and quality of the nozzle plate 16 having a total of 64 through 128 nozzles 15 are important factors to determine the ink drop configuration and discharging characteristics of the ink jet printing head. The picture quality of an image produced by the ink jet printing head is greatly influenced by the ink drop configuration and discharging characteristics of the ink jet printing head.

In order to produce the above-described ink jet printing head, the actuator unit 1 and the ink chamber unit 2 are separately prepared, and the two units 1 and 2 are bonded to each other after they are prepared. The ink jet printing head of the present invention is thus produced.

Next, a description will be given of a method of preparing the ink chamber unit 2 of the ink jet printing head of the present invention with reference to FIGS. 6A through 8. A method of preparing the actuator unit 1 of the ink jet printing head is known, and a description thereof will be omitted.

FIGS. 6A through 6E show preparing procedures which are performed to prepare the oscillation plate 12 with the lower ink passage layer 22 thereon.

Figure 6A:
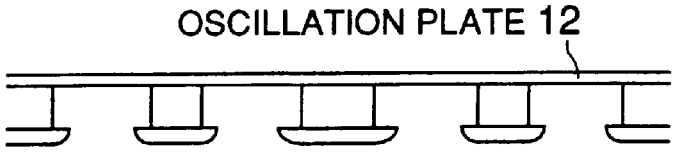
FIGS. 6A through 6E are diagrams for explaining a method of preparing an oscillation plate with a lower ink passage layer thereon.
Figure 6B:
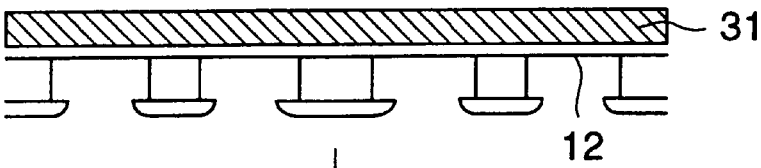

The oscillation plate 12 is prepared through electroforming by using a thin sheet of nickel (Ni) as shown in FIG. 6A. After the oscillation plate 12 is prepared, a negative dry film resist 31 is laminated on the flat surface of the oscillation plate 12 by applying heat and pressure as shown in FIG. 6B. The negative dry film resist 31 is a photosensitive resin material used to form the lower ink passage layer 22 on the oscillation plate 12. The thickness of the dry film resist 31 on the oscillation plate 12 is in the range of 20 $\mu$m to 50 $\mu$m.

Figure 6C:
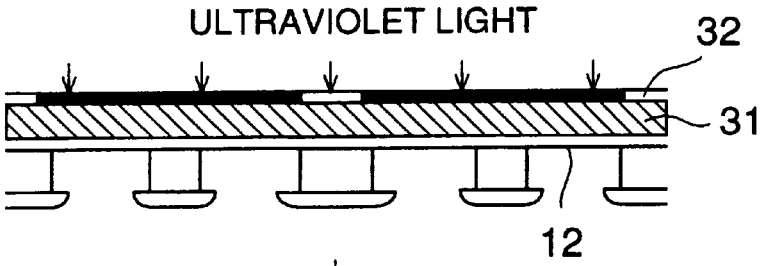
Figure 6D:
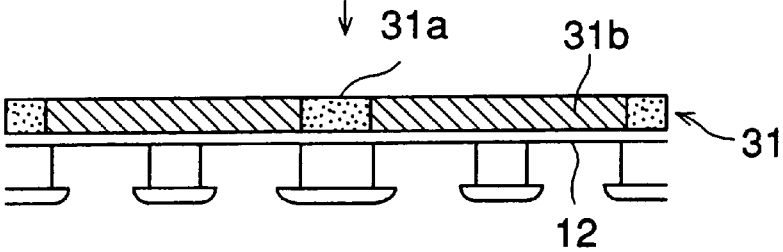

By placing a mask 32 having a predetermined ink passage pattern on the dry film resist 31, it is exposed to ultraviolet light as shown in FIG. 6C, so that the exposed portions of the dry film resist 31 are cured. After the exposure to ultraviolet light is performed and the mask 32 is removed, the dry film resist 31 includes a plurality of cured portions 31*a* and a plurality of non-cured portions 31*b* as shown in FIG. 6D.

Figure 6E:
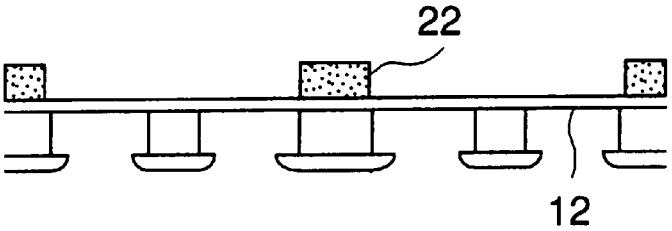

By using a solvent capable of removing the non-cured portions 31*b* from the dry film resist 31, developing of the dry film resist 31 is performed so that the non-cured portions 31*b* are removed. After the developing is performed, the oscillation plate 12 with the lower ink passage layer 22 thereon is formed as shown in FIG. 6E. Thus, the predetermined ink passage pattern on the entire oscillation plate 12, corresponding to the lower ink passage layer 22, is formed.

After the oscillation plate 12 with the lower ink passage layer 22 thereon is rinsed in water, it is dried. Then, it is again exposed to ultraviolet light. By applying heat, the lower ink passage layer 22 on the oscillation plate 12 is finally cured.

FIGS. 7A through 7E show a method of preparing the nozzle plate 16 with the upper ink passage layer 23 thereon.

Figure 7A:
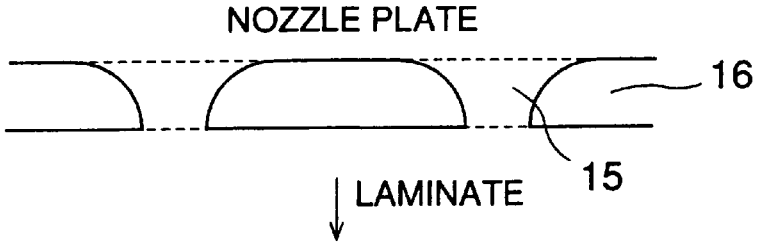
FIGS. 7A through 7E are diagrams for explaining a method of preparing a nozzle plate with an upper ink passage layer thereon.
Figure 7B:
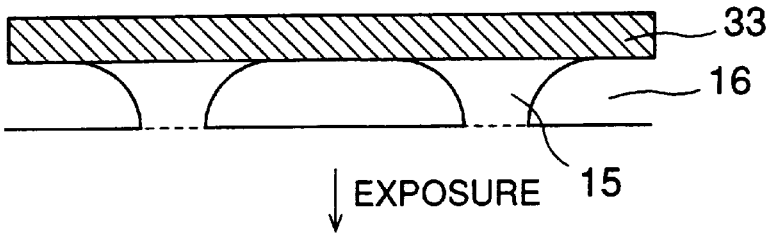

The nozzle plate 16 including the nozzles is prepared through electroforming by using nickel (Ni) as shown in FIG. 7A. Since the electroforming is performed, each of the nozzles 15 of the nozzle plate 16 has a flared inside surface in which the diameter of the inside surface is continuously reduced toward the outside surface (the lower surface in FIG. 7A) of the nozzle plate 16. After the nozzle plate 16 including the nozzles 15 is prepared, a negative dry film resist 33 is laminated on the nozzle plate 16 by applying heat and pressure as shown in FIG. 7B. The dry film resist 33 is a photosensitive resin material used to form the upper ink passage layer 23 on the nozzle plate 16. The thickness of the dry film resist 33 on the nozzle plate 16 is in the range of 40 $\mu$m to 100 $\mu$m.

Figure 7C:
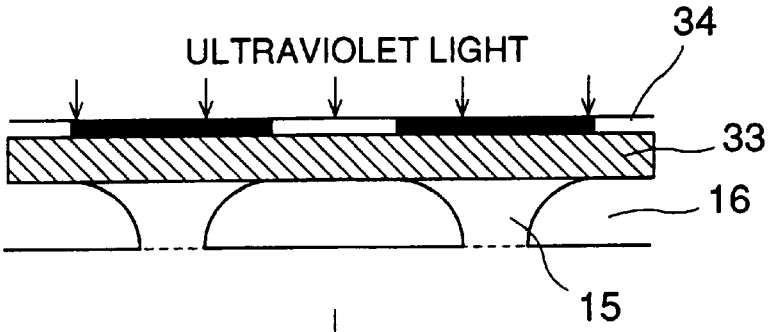
Figure 7D:
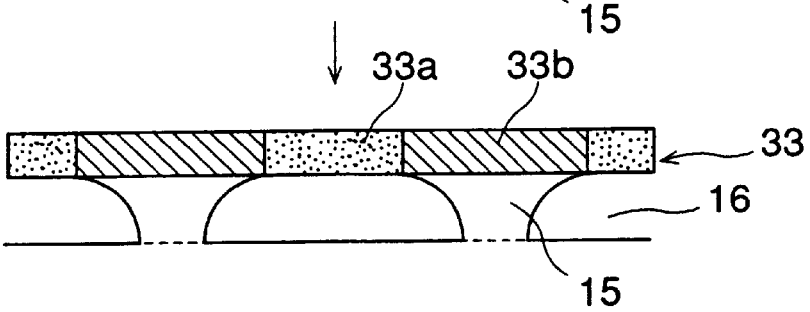

By placing a mask 34 having a predetermined ink passage pattern on the dry film resist 33, it is exposed to ultraviolet light as shown in FIG. 7C, so that the exposed portions of the dry film resist 33 are cured. After the exposure to ultraviolet light is performed and the mask 34 is removed, the dry film resist 33 includes a plurality of cured portions 33*a* and a plurality of non-cured portions 33*b* as shown in FIG. 7D.

Figure 7E:
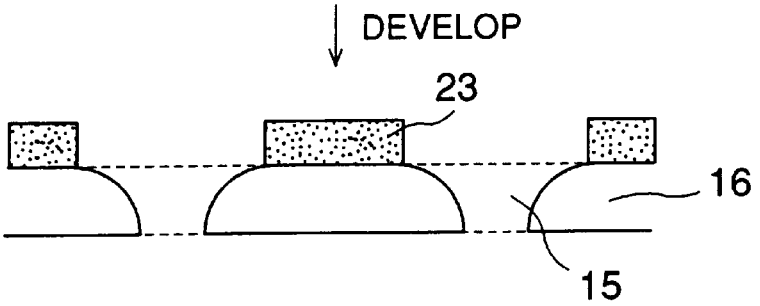

By using a solvent capable of removing the non-cured portions 33*b* from the dry film resist 33, developing of the dry film resist 33 is performed so that the non-cured portions 33*b* are removed. After the developing is performed, the nozzle plate 16 with the upper ink passage layer 23 thereon is formed as shown in FIG. 7E. Thus, the predetermined ink passage pattern on the entire nozzle plate 16, corresponding to the upper ink passage layer 23, is formed.

After the nozzle plate 16 with the upper ink passage layer 23 thereon is rinsed in water, it is dried. Then, it is again exposed to ultraviolet light. By applying heat, the upper ink passage layer 23 on the nozzle plate 16 is finally cured.

Figure 8:
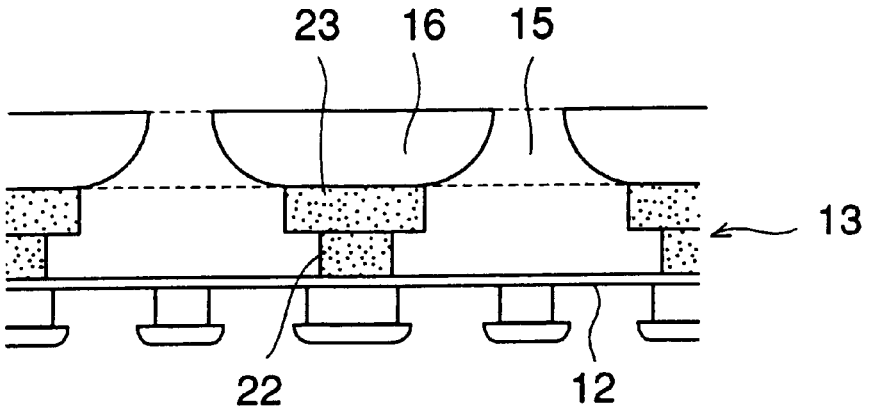
FIG. 8 is a diagram for explaining a bonding procedure in which the oscillation plate and the nozzle plate are bonded.

FIG. 8 shows a bonding procedure in which the oscillation plate 12 and the nozzle plate 16 are bonded.

As shown in FIG. 8, the oscillation plate 12 and the nozzle plate 16 are bonded so that the upper ink passage layer 23 on the nozzle plate 16 are bonded to the lower ink passage layer 22 on the oscillation plate 12 so as to form the ink passage member 13. The bonding procedure is performed by using a positioning jig (not shown) and applying heat. The oscillation plate 12 and the nozzle plate 16 are heated to a temperature that is higher than the temperature used when the laminating procedures in FIGS. 6B and 7B and the final curing procedures in FIGS. 6E and 7E are performed. Practically, the bonding procedure is performed with a sufficiently large common plate which includes a number of ink jet printing heads.

Figure 9:
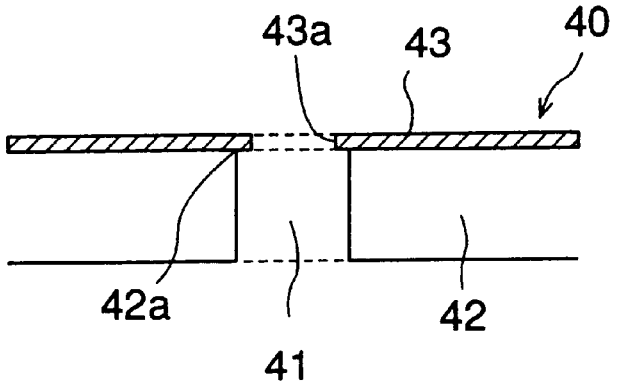
FIG. 9 is an enlarged cross-sectional view of a surface treated nozzle plate of the ink jet printing head in one embodiment of the present invention.

FIG. 9 shows a surface treated nozzle plate of the ink jet printing head in one embodiment of the present invention.

In the ink jet printing head of the present invention, the term "nozzle plate" is used to provide a general concept of a nozzle-containing member made up of a nozzle member and two or more other members, as well as a nozzle-containing member made up of a nozzle-containing plate integrally formed with an ink passage member. Using the term "nozzle plate" in the present specification is not intended to mean only a nozzle-containing plate.

The ink jet printing head in the present embodiment includes a surface treated nozzle plate 40 shown in FIG. 9. The surface treated nozzle plate 40 includes a nozzle plate 42 and a surface treatment layer 43 formed on the nozzle plate 42.

The nozzle plate 42 includes a plurality of nozzles 41 each of which has a straight-line rectangular cross-section. Each nozzle 41 has a first inside diameter at a peripheral edge 42*a* of the nozzle plate 42.

The surface treatment layer 43 includes a plurality of openings corresponding to the nozzles 41, and each opening has a second inside diameter at a peripheral edge 43*a* of the surface treatment layer 43. The surface treatment layer 43 is formed such that the peripheral edge 43*a* inwardly projects from the peripheral edge 42*a* of the nozzle plate 42. The second inside diameter of the openings of the surface treatment layer 43 is smaller than the first inside diameter of the nozzle 41.

In the present embodiment, the second inside diameter of the openings of the surface treatment layer 43 is smaller than the first inside diameter of the nozzles 41 of the nozzle plate 42. The ink jet printing head of the present embodiment can efficiently transmit the energy to the ink when the ink is discharged. Therefore, it is possible for the ink jet printing head of the present embodiment to provide a stable, constant discharge of ink, thus producing an image with increased picture quality.

Figure 10:
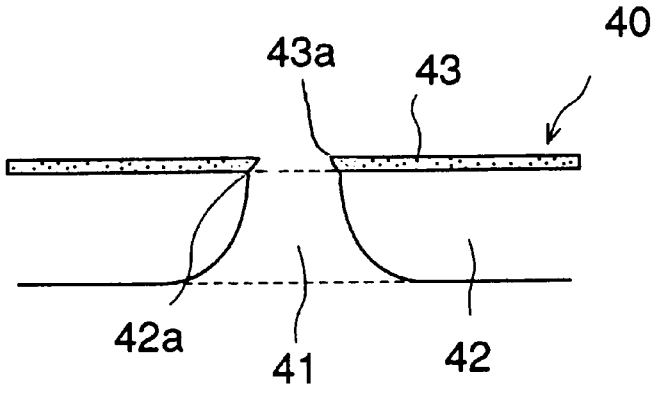
FIG. 10 is an enlarged cross-sectional view of a surface treated nozzle plate of the ink jet printing head in another embodiment of the present invention.

FIG. 10 shows a surface treated nozzle of the ink jet printing head in another embodiment of the present invention.

The ink jet printing head in the present embodiment includes a surface treated nozzle plate 40 shown in FIG. 10. The surface treated nozzle plate 40 includes a nozzle plate 42 and a surface treatment layer 43 formed on the nozzle plate 42.

Referring to FIG. 10, the nozzle plate 42 includes a plurality of nozzles 41 each of which has a flared inside surface. Each nozzle 41 has a first inside diameter at a peripheral edge 42*a* of the nozzle plate 42.

The surface treatment layer 43 includes a plurality of openings corresponding to the nozzles 41, and each opening has a second inside diameter at a peripheral edge 43*a* of the surface treatment layer 43. The surface treatment layer 43 with the openings is formed such that the peripheral edge 43*a* inwardly projects from and is smoothly continuous to the peripheral edge 42*a* of the nozzle plate 42. The second inside diameter of the openings of the surface treatment layer 43 is smaller than the first inside diameter of the nozzle 41.

In the present embodiment, each of the nozzles 41 of the nozzle plate 42 has a flared inside surface in which the diameter of the inside surface is continuously reduced toward the outside surface of the nozzle plate 42. The second inside diameter of the openings of the surface treatment layer 43 is smaller than the first inside diameter of the nozzles 41 of the nozzle plate 42. In addition, the peripheral edge 43*a* of the surface treatment layer 43 is smoothly continuous to and inwardly projects from the peripheral edge 42*a* of the nozzle plate 42.

Accordingly, bubbles in the ink hardly stay at the peripheral edge 42*a*, and the ink jet printing head of the present embodiment can efficiently transmit the energy to the ink when the ink is discharged. It is possible for the ink jet printing head of the present embodiment to prevent the lowering of the discharging of ink due to the bubbles staying at the peripheral edge 42*a*. The efficiency of the discharging of ink in the ink jet printing head of the present embodiment is thus increased. Therefore, it is possible for the ink jet printing head of the present embodiment to provide a stable, constant discharge of ink, thus producing an image with increased picture quality.

According to the present invention, the ratio of the inside diameter of the openings of the surface treatment layer 43 at the peripheral edge 43*a* to the inside diameter of the nozzles 41 of the nozzle plate 42 at the peripheral edge 42*a* is preferably in the range of 50% to 100%. If the ratio is above 100%, it is difficult to efficiently transmit the energy to the ink when it is discharged as in the conventional ink jet printing head. If the ratio is below 50%, the discharging characteristic of the ink jet printing head may be considerably influenced because of too small openings of the surface treatment layer 43. If the ratio is in the range of 50% to 100%, it is possible to efficiently transmit the energy to the ink when it is discharged, so that the ink jet printing head provides a stable, constant discharge of ink.

Figure 26:
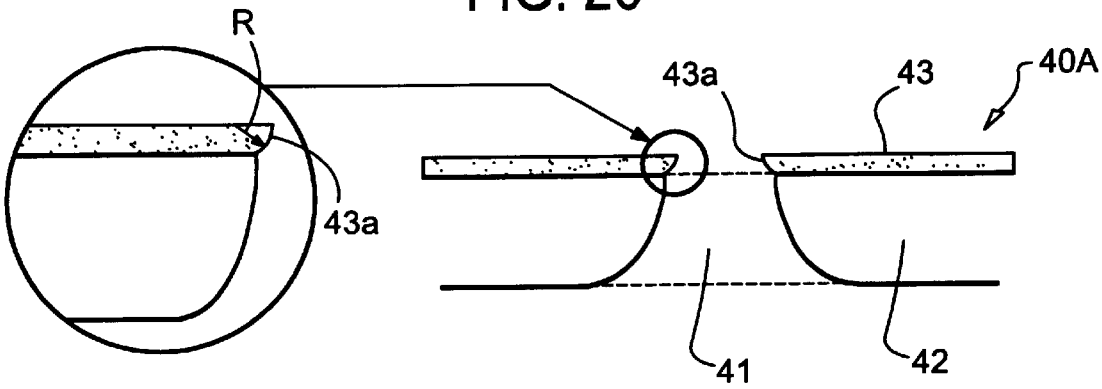
FIGS. 26 and 27 are diagrams for explaining a surface treated nozzle plate of the ink jet printing head in a further embodiment of the present invention and a comparative example of the surface treated nozzle plate.
Figure 27:
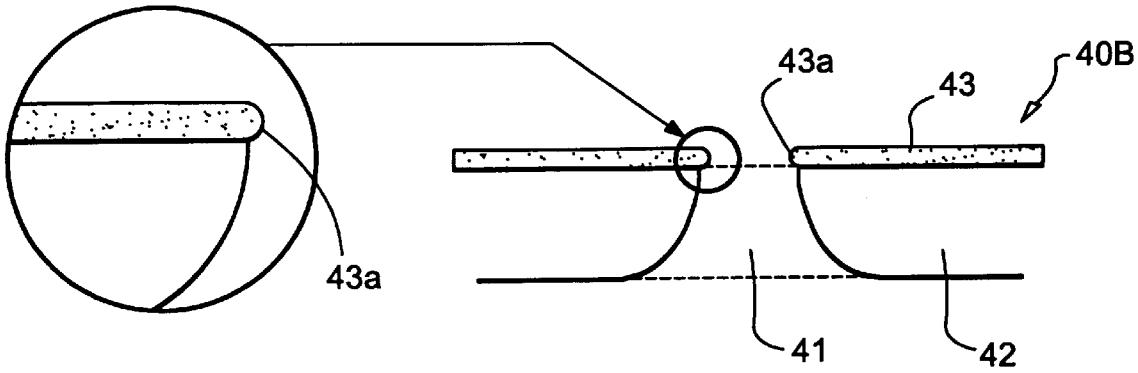

FIG. 26 and FIG. 27 show a surface treated nozzle plate 40A of the ink jet printing head in a further embodiment of the present invention and a comparative example 40B of the surface treated nozzle plate, respectively.

Referring to FIG. 26, in the surface treated nozzle plate 40A, the peripheral edge 43*a* of the surface treatment layer 43 has a straight-line outside surface adjacent to one of the openings in the surface treatment layer 43. As shown, the straight-line outside surface of the peripheral edge 43*a* of the surface treatment layer 43 is substantially parallel to the outside surface of the nozzle plate 42.

Referring to FIG. 27, in the comparative example 40B of the surface treated nozzle plate, the peripheral edge 43*a* of the surface treatment layer 43 is rounded, and its outside surface adjacent to one of the openings in the surface treatment layer 43 is not parallel to the outside surface of the nozzle plate 42. The discharging direction of the ink, discharged from the nozzle 41 of the comparative example, may be dispersed because of the rounded edge.

In the surface treated nozzle plate 40A of the present embodiment, shown in FIG. 26, the dispersal of the discharging direction of the ink can be prevented, and the discharging efficiency of the ink jet printing head is increased. By taking into account the increase of the discharging efficiency of the ink jet printing head, the peripheral edge 43*a* of the surface treatment layer 43 in the surface treated nozzle plate 40A has a radius R that is below 1 $\mu$m.

Figure 28:
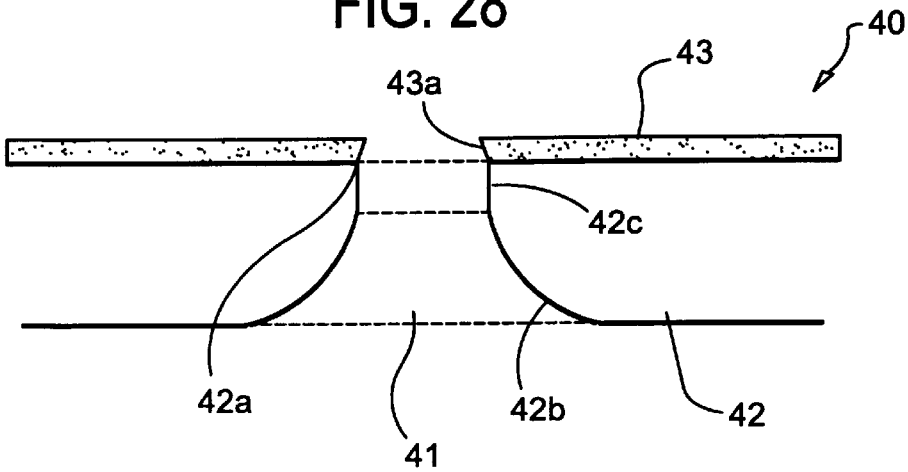
FIG. 28 is an enlarged cross-sectional view of a surface treated nozzle plate of the ink jet printing head in another embodiment of the present invention.

FIG. 28 shows a surface treated nozzle plate 40 of the ink jet printing head in another embodiment of the present invention.

Referring to FIG. 28, each nozzle 41 of the nozzle plate 42 has an inside surface including a flared portion 42*b* extending from the ink chamber 17 (as shown in FIGS. 4 and 5) and a generally cylindrical portion 42*c* extending from the flared portion 42*b*. The flared portion 42*b* is formed through electroforming such that the diameter of the inside surface is continuously reduced toward the outside surface of the nozzle plate 42. The cylindrical portion 42*c* is formed through additional electroforming such that it is smoothly continuous to one of the openings of the surface treatment layer 43 at the peripheral edge 42*a* of the nozzle plate 42.

In the present embodiment, the nozzle plate 42 has the inside surface of each nozzle 41 which includes the flared portion 42*b* and the generally cylindrical portion 42*c*. Accordingly, it is possible for the ink jet printing head of the present embodiment to prevent the lowering of the discharging of ink due to the bubbles staying at the peripheral edge 42*a*. The efficiency of the discharging of ink in the ink jet printing head of the present embodiment is thus increased. Therefore, it is possible for the ink jet printing head of the present embodiment to provide a stable, constant discharge of ink, thus producing an image with increased picture quality.

A further description of the surface treated nozzle plate 40 of the present embodiment and a description of a method of the surface treated nozzle plate 40 of the present embodiment will be given later.

The surface treatment process which is used to form the surface treatment layer 43 on the ink jet printing head of the present invention is preferably a water-repellent surface treatment.

By forming the surface treatment layer 43 through the water-repellent surface treatment, the occurrence of ink residue on the nozzle plate 42 can be prevented. It is possible to prevent the lowering of the discharging efficiency and the deflection of the discharging direction caused by the ink residue.

There are several types of the water-repellent surface treatment processes which can be applied to form the surface treatment layer 43 on the ink jet printing head of the present invention. For example, coating of silicon-containing compound or fluorine-containing compound, forming of a plasma polymerized layer or thermal evaporated layer of the same, and composite plating of fluorine-containing high-molecular compound can be applied to form the surface treatment layer 43.

Examples of the fluorine-containing compound which can be used when the above composite plating is applied are: tetrafluoroethylene resin (PTFE), tetrafluoroethylene-hexafluoropropylene copolymer (FEP), tetrafluoroehtylene-perfluoroalkylvinylether copolymer (PFA), ethylene-tetrafluoroethylene copolymer (ETFE), ethylene-trifluorochloridethylene copolymer (ECTFE), trifluoroethylene resin (PCTFE), polyvinyl fluoride resin (PVF), tetrafluoroethylene-hexafluoropropylene-perfluoroalkylvinylether copolymer (EPE), polyvinyliden fluoride (PVDF), other thermoplastic fluororesin, other thermoplastic fluoroelastomer, other fluorine-containing copolymer, and other fluorocarbon compounds such as (CF)N and ($C_2$F)F. Particularly, the fluorine-containing compound which is preferably used for the above composite plating is tetrafluoroethylene resin (PTFE) or fluorocarbon compounds.

Examples of metal which can be used when the above composite plating is applied are: nickel (Ni), chrome (Cr), silver (Ag) and copper (Cu). Particularly, the metal which is preferably used for the above composite plating is nickel.

According to the method of producing the ink jet printing head of the present invention, the above water-repellent surface treatment is carried out by using: (1) nickel and fluorine-containing resin, composite electroplating; or (2) nickel, phosphorus and fluorine-containing resin, electroless composite plating.

When (1) nickel and fluorine-containing resin, composite electroplating is performed, the surface treatment layer 43 having a desired opening diameter and a desired shape can be easily formed on the nozzle plate 42 by laying up the electroplating. The ink jet printing head having the thus formed surface treatment layer 43 provides an increased resistance to wiping.

When (2) nickel, phosphorus and fluorine-containing resin, electroless composite plating is performed, the surface treatment layer 43 having a desired opening diameter and a desired shape can be easily formed on the nozzle plate 42 by laying up the plating. The ink jet printing head having the thus formed surface treatment layer 43 provides an increased resistance to wiping. Further, the thus formed surface treatment layer 43 can have a uniform thickness without irregular thickness.

In order to keep the outside nozzle-surrounding surface of the ink jet printing head clean after the printing head is installed in a printer system, wiping the outside nozzle-surrounding surface of the ink jet printing head is performed. Thus, it is necessary that the surface treatment layer 43 on the nozzle plate 42 has a thickness great enough to resist to the wiping. However, if the surface treatment layer 43 on the nozzle plate 42 is too thick, the cost for preparing the surface treatment layer 43 becomes high, and the nozzle plate 42 in such a case may camber.

Accordingly, the thickness of the surface treatment layer 43 on the nozzle plate 42 is preferably in the range of 1 $\mu$m–10 $\mu$m.

When the surface treatment layer 43 is formed by using the fluorine-containing resin composite plating, the content of the fluorine-containing resin in the surface treatment layer 43 is preferably in the range of 20%–40% in volume.

If the content is below 20% in volume, the water-repellent ability of the surface treatment layer 43 becomes inadequate. If the content is above 40% in volume, the resistance to wiping becomes too low and the adhesion between the surface treatment layer 43 and the nozzle plate 42 becomes too low.

According to the method of producing the ink jet printing head of the present invention, it is preferable to perform a hydrophilic surface treatment when preparing the nozzle plate 42 having the nozzles 41. The hydrophilic surface treatment is carried out by using (1) acid etching, (2) dry etching, or (3) metal sputtering.

When (1) acid etching is performed using nitric acid ($HNO_3$) or metal salt (such as $FeCl_3$), the surface of the nozzle plate 42 is formed to be hydrophilic. This surface treatment can be easily performed, and the productivity of the surface treated nozzle plate is high. When (2) dry etching is performed, the surface of the nozzle plate 42 is formed to be hydrophilic. This surface treatment is preferable to make only the inside surfaces of the nozzles 21 of the nozzle plate 42 hydrophilic. When (3) metal sputtering is performed using gold (Au), the surface of the nozzle plate 42 is formed to be hydrophilic. The cost of this hydrophilic surface treatment is relatively high.

According to the method of producing the ink jet printing head of the present invention, it is preferable to perform the above hydrophilic surface treatment in addition to the water-repellent surface treatment when producing the ink jet printing head. As described above, the hydrophilic surface treatment is performed to make the inside surfaces of the nozzles 41 of the nozzle plate 42 hydrophilic. If the hydrophilic surface treatment is not performed, the meniscus at the edge of the nozzles 41 of the nozzle plate 42 may become too retracted. The water-repellent surface treatment is performed to form the surface treatment layer 43 on the outside surface of the nozzle plate 42, which is made water-repellent.

Figure 11A:
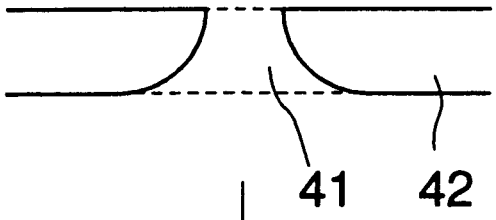
FIGS. 11A through 11C are diagrams of a surface treated nozzle plate of the ink jet printing head in still another embodiment of the present invention.
Figure 11B:
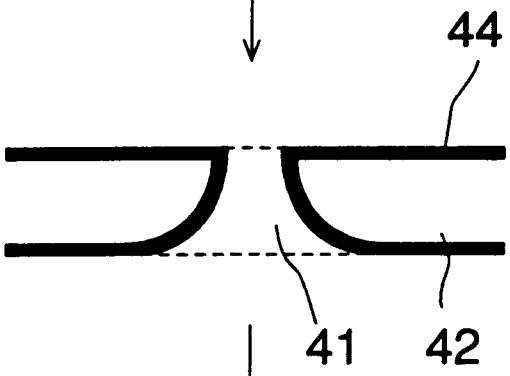
Figure 11C:
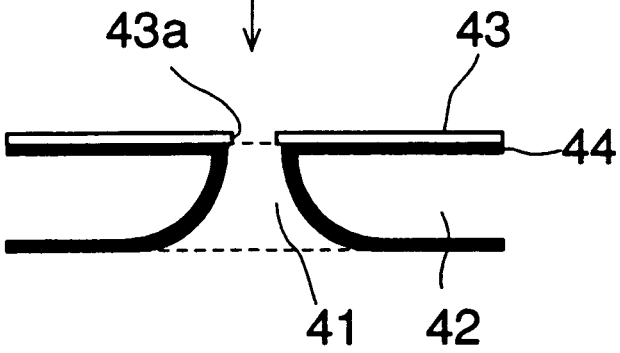

FIGS. 11A through 11C show a surface treated nozzle plate of the ink jet printing head in still another embodiment of the present invention. In preparing the surface treated nozzle plate in the present embodiment, both the hydrophilic surface treatment and the water-repellent surface treatment are performed.

In the present embodiment, the nozzle plate 42 having the nozzles 41 in FIG. 11A is subjected to the hydrophilic surface treatment by using one of the above-mentioned procedures. A hydrophilic surface layer 44 is formed on all the outside and inside surfaces of the nozzle plate 42, as shown in FIG. 11B.

After the hydrophilic surface treatment is performed, the water-repellent surface treatment is performed by using one of the above-mentioned procedures. The surface treatment layer 43 is formed on the outside surface of the nozzle plate 42 as shown in FIG. 11C. Accordingly, in the surface treated nozzle plate of the present embodiment, the inside surfaces of the nozzles 41 of the nozzle plate 42 are made hydrophilic and the outside surface of the nozzle plate 42 is made water-repellent.

It is possible for the ink jet printing head of the present embodiment to provide a stable, constant discharge of ink because of the hydrophilic inside surfaces of the nozzles 41 and the water-repellent surface treatment layer 43. The ink jet printing head of the present embodiment can produce an image with a further increased picture quality.

FIGS. 12A through 12G show an ink jet printing head production method in one embodiment of the present invention.

Figure 12A:
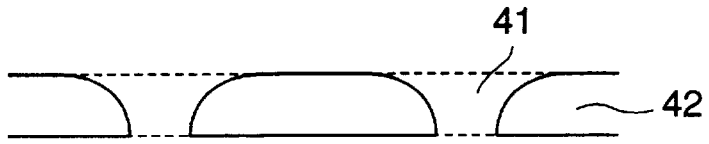
FIGS. 12A through 12G are diagrams for explaining an ink jet printing head production method in one embodiment of the present invention.

As shown in FIG. 12A, the nozzle plate 42 including the nozzles 41 is prepared through electroforming by using metal such as nickel (Ni). As the nozzle plate 42 is made of the sheet of metal, a surface treatment such as plating can be applied. As the electroforming is performed, each nozzle 41 of the nozzle plate 42 has a flared inside surface in which the diameter of the inside surface is continuously reduced toward the outside surface of the nozzle plate 42, and it facilitates the peripheral edge of the nozzle plate 42 to be smoothly continuous to the surface treatment layer 43.

Figure 12B:
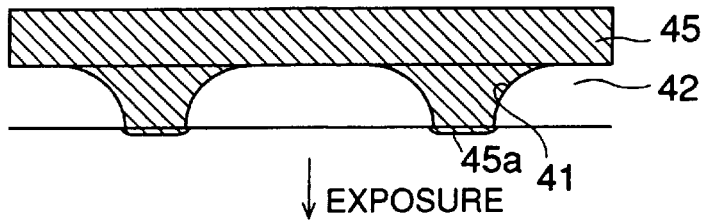

As shown in FIG. 12B, a negative dry film resist 45 is laminated to the inside surface (the upper surface in FIG. 12B) of the nozzle plate 42. The inside surface of the nozzle plate 42 is attached to an ink passage member 13 forming a plurality of ink chambers 17 as shown in FIGS. 4 and 5. By controlling the laminating temperature and pressure, the dry film resist 45 including a plurality of projecting portions 45*a* is formed. The projecting portions 45*a* project from the nozzles 41 below the outside surface (the lower surface in FIG. 12B) of the nozzle plate 42 as shown in FIG. 12B. The amount of projection of the projecting portions 45*a* below the outside surface of the nozzles plate 42 is determined in accordance with the thickness of the surface treatment layer 43.

Figure 12C:
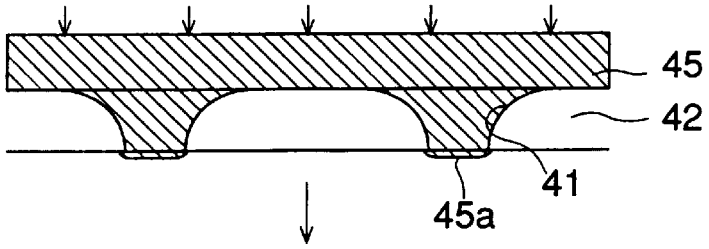

As shown in FIG. 12C, the dry film resist 45 on the inside surface of the nozzle plate 42 is exposed to ultraviolet light. The ultraviolet light is applied to the dry film resist 45 on the side of the inside surface of the nozzle plate 42 only. All the areas of the dry film resist 45 except those concealed by the nozzle plate 42 are exposed to the ultraviolet light.

Figure 12D:
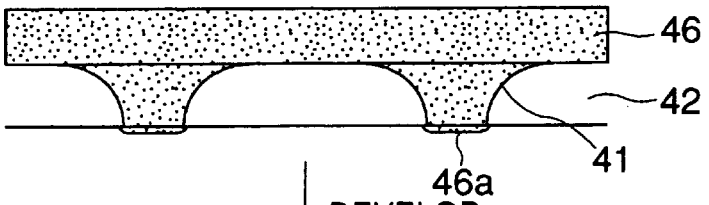

As shown in FIG. 12D, the dry film resist 45 and the projecting portions 45*a* are cured by the exposure so that a cured dry film resist 46 including cured projecting portions 46*a* on the nozzle plate 42 is formed.

Figure 13:
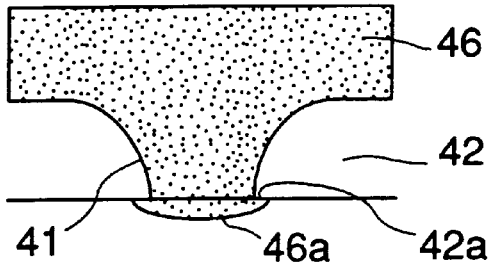
FIG. 13 is an enlarged cross-sectional view of a cured dry film resist on a nozzle plate in FIG. 12D.

FIG. 13 shows the cured dry film resist 46 on the nozzle plate 42 in FIG. 12D. As shown in FIG. 13, the cured dry film resist 46 includes the cured projecting portions 46*a*. The areas of the dry film resist 45 concealed by the peripheral edges 42*a* of the nozzle plate 42 are not cured, and the cured projecting portions 46*a* uprightly project from the nozzles 41 beyond the outside surface of the nozzle plate 42.

Figure 12E:
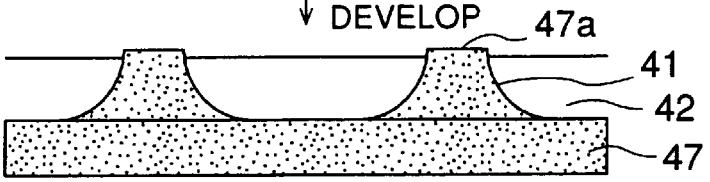

As shown in FIG. 12E, the cured dry film resist 46 on the nozzle plate 42 (it is turned upside down in FIG. 12E) is developed so that a dry film resist pattern 47 including a plurality of developed projecting portions 47*a* is formed.

Figure 14:
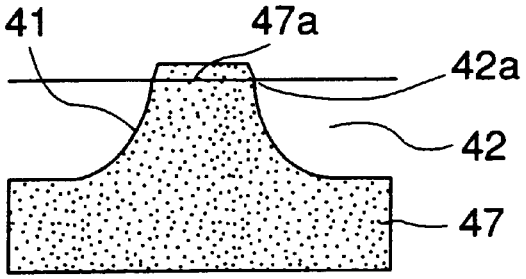
FIG. 14 is an enlarged cross-sectional view of a dry film resist pattern on the nozzle plate in FIG. 12E.

FIG. 14 shows the dry film resist pattern 47 on the nozzle plate 42 in FIG. 12E. As shown in FIG. 14, the projecting portions 47*a* uprightly project from the nozzles 41 beyond the outside surface of the nozzle plate 42. By controlling the exposing quantity used in FIG. 12C and the developing time used in FIG. 12E, it is possible to obtain a desired shape of the projecting portions 47*a* of the dry film resist pattern 47.

Figure 15A:
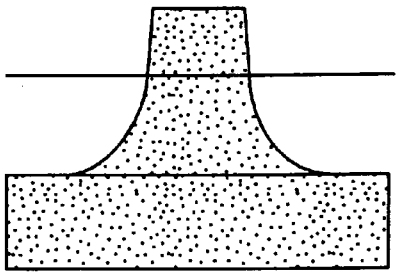
FIGS. 15A and 15B are diagrams for explaining a relationship between the dry film resist pattern and the exposing quantity and developing time.
Figure 15B:
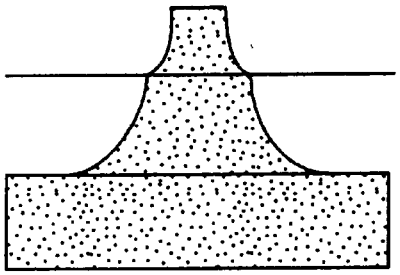

FIGS. 15A and 15B show a relationship between the dry film resist pattern 47 and the exposing quantity and developing time. As shown, when the exposing quantity is great and the developing time is short, the projecting portions 47*a* become relatively broad, and when the exposing quantity is small and the developing time is long, the projecting portions 47*a* become relatively thin.

Generally, the diameter of the projecting portions 47*a* of the dry film resist pattern 47 varies depending on the kind and the thickness of the dry film resist 45. In the present embodiment, the exposing quantity is preferably in the range of 1–10 J, and the developing time is preferably in the range of 2–5 minutes.

Figure 12F:
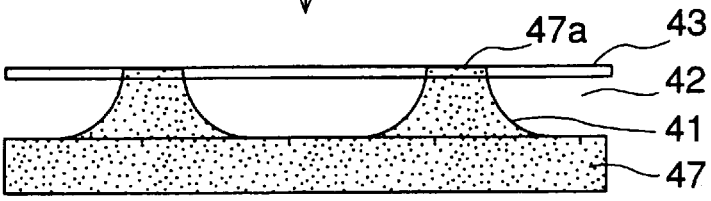

As shown in FIG. 12F, the water-repellent surface treatment is performed so that the surface treatment layer 43 with a desired thickness on the outside surface of the nozzle plate 42 is formed. For example, the nickel and fluorine-containing resin composite electroplating is used to form the surface treatment layer 43. It is important to the present invention that the thickness of the surface treatment layer 43 formed on the nozzle plate 42 is slightly smaller than the thickness of the projecting portions 47*a* on the nozzle plate 42.

If the thickness of the surface treatment layer 43 is greater than the thickness of the projecting portions 47*a,* two problems may arise: (1) it is difficult to form the surface treatment layer 43 with accurate diameters of the openings corresponding to the nozzles 41; and (2) it is difficult to smoothly remove the projecting portions 47*a* from the surface treated nozzle plate 42 at a following step.

Figure 12G:
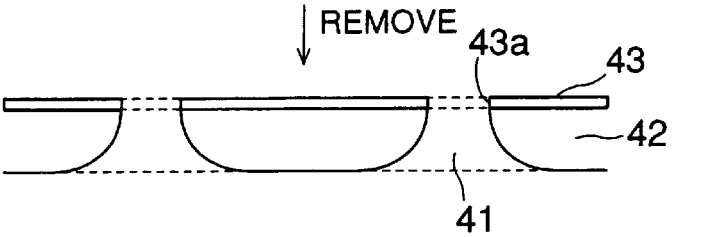

As shown in FIG. 12G, the dry film resist pattern 47 is removed from the surface treated nozzle plate 42. The nozzle plate 42 with the surface treatment layer 42 on the outside surface of the nozzle plate 42 is thus produced.

Figure 16:
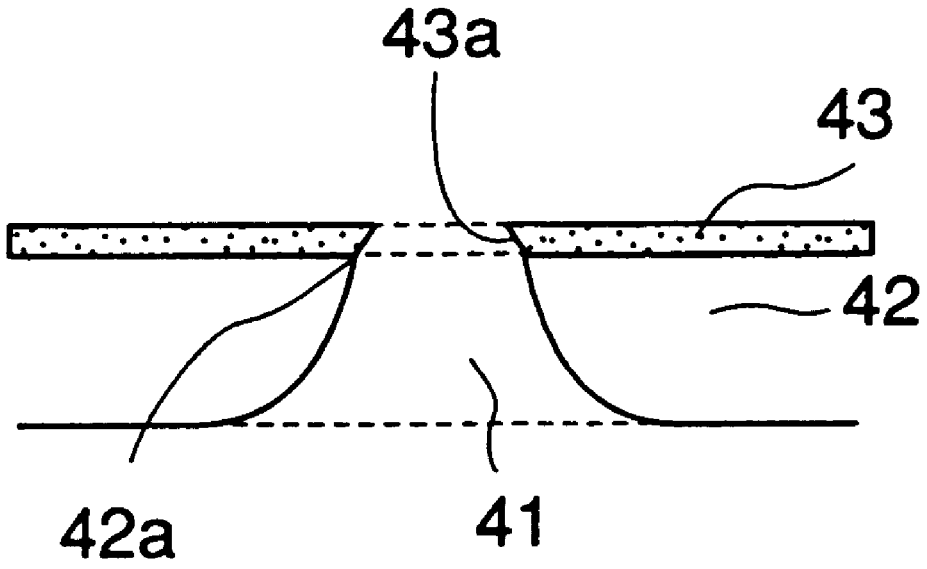
FIG. 16 is an enlarged cross-sectional view of a surface treated nozzle plate produced by the ink jet printing head production method in FIGS. 12A through 12G.

FIG. 16 shows the surface treated nozzle plate 42 produced by the ink jet printing head production method in FIGS. 12A through 12G. As shown, the surface treatment layer 43 on the outside surface of the nozzle plate 42 includes a plurality of openings overlapping the nozzles 41 of the nozzle plate 42, each opening having a second diameter at the peripheral edge 43*a* of the surface treatment layer 43, the second diameter being smaller than the first diameter of each nozzle 41 at the peripheral edge 42*a* of the nozzle plate 42.

When the dry film resist pattern 47 including the projecting portions 47*a* on the nozzle plate 42 is formed, there are the following restrictions: (1) since the dry film resist 45 on the inside surface of the nozzle plate 42 is exposed to ultraviolet light, the diameter of the projecting portions 47*a* is not greater than the first diameter of the nozzles 42; (2) since the developing of the cured dry film resist 46 is performed on the outside surface of the nozzle plate 42, the crosslinking ratio of the upper areas (opposite to the developing side) of the cured dry film resist 46 becomes low and the diameter of the projecting portions 47 tends to be reduced; and (3) if the exposing quantity is lowered to reduce the diameter of the projecting portions 47*a* to a too small diameter, the cylindricity of the dry film resist pattern 47 becomes poor and the shape of the nozzles 41 becomes unsuitable.

By taking into account the above-described restrictions, in the present embodiment, the ratio of the second diameter of the openings of the surface treatment layer 43 to the first diameter of the nozzles 41 of the nozzle plate 42 is in the range of 50%–100%.

As described above, it is possible for the ink jet printing head production method of the present embodiment to easily and efficiently produce an ink jet printing head which provides a stable, constant discharge of ink.

FIGS. 17A through 18D show an ink jet printing head production method in another embodiment of the present invention.

Figure 17A:
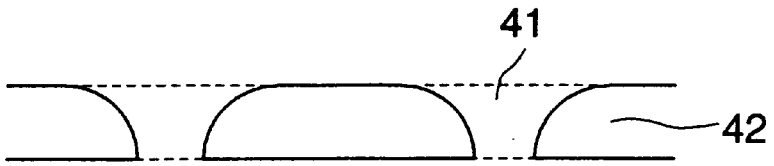
FIGS. 17A through 17D are diagrams for explaining an ink jet printing head production method in another embodiment of the present invention.

As shown in FIG. 17A, the nozzle plate 42 including the nozzles 41 is prepared through electroforming by using metal such as nickel (Ni).

Figure 17B:
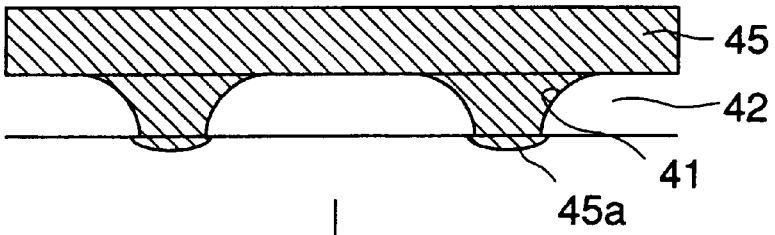

As shown in FIG. 17B, a negative dry film resist 45 is laminated to the inside surface of the nozzle plate 42. By controlling the laminating temperature and pressure, the dry film resist 45 including a plurality of projecting portions 45*a* is formed. The projecting portions 45*a* project from the nozzles 41 beyond the outside surface of the nozzle plate 42 as shown in FIG. 17B.

Figure 17C:
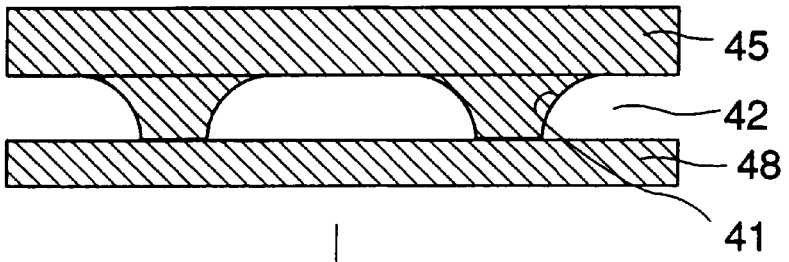

As shown in FIG. 17C, a negative dry film resist 48 is further laminated to the outside surface of the nozzle plate 42. The projecting portions 45*a* of the dry film resist 45 at this time are bonded to the dry film resist 48 without space between the projecting portions 45*a* and the dry film resist 48. If the amount of projection of the projecting portions 45*a* on the outside surface of the nozzle plate 42 is inadequate, air may enter the space of the nozzles 41 between the projecting portions 45*a* and the dry film resist 48 when the dry film resist 48 is laminated. This may influence the shape and strength of the projecting portions of a subsequently formed dry film resist pattern.

Figure 17D:
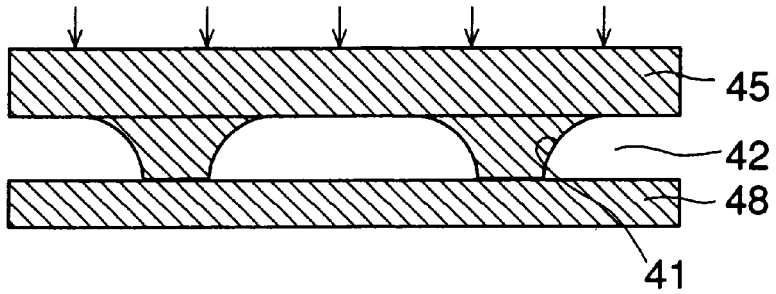

As shown in FIG. 17D, the dry film resist 45 on the inside surface of the nozzle plate 42 is exposed to ultraviolet light. The ultraviolet light is applied to the dry film resist 45 on the side of the inside surface of the nozzle plate 42 only. All the areas of the dry film resist 45 and the dry film resist 48 except those concealed by the nozzle plate 42 are exposed to the ultraviolet light.

Figure 18A:
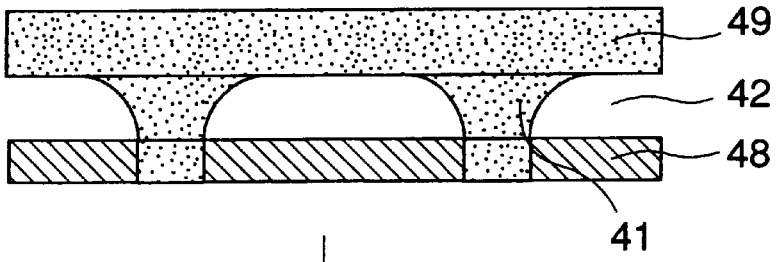
FIGS. 18A through 18D are diagrams for explaining the ink jet printing head production method following the steps in FIGS. 17A through 17D.

As shown in FIG. 18A, the dry film resist 45 and the areas of the dry film resist 48 corresponding to the projecting portions 45*a* are cured by the exposure, so that a cured dry film resist 49 including the cured dry film resist 45 and the cured areas of the dry film resist 48 is formed. The other areas of the dry film resist 48 are concealed by the nozzle plate 42, and they are not cured.

Figure 18B:
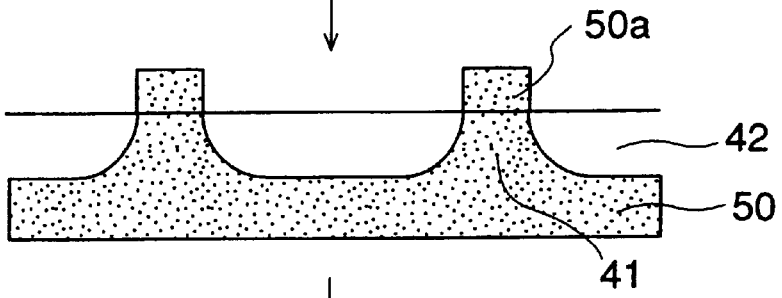

As shown in FIG. 18B, the cured dry film resist 49 on the nozzle plate 42 (it is turned upside down in FIG. 18B) is developed so that a dry film resist pattern 50 including a plurality of projecting portions 50*a* corresponding to the cured areas of the dry film resist 48 is formed. The non-cured areas of the dry film resist 48 are removed by the developing.

Figure 19:
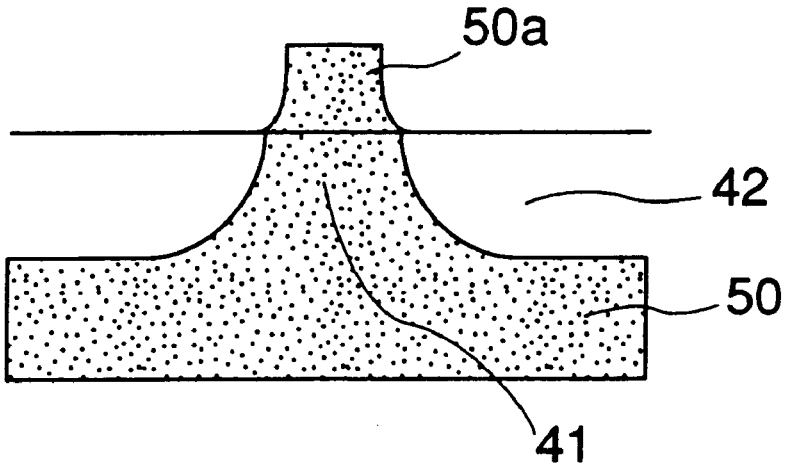
FIG. 19 is an enlarged cross-sectional view of a dry film resist pattern in FIG. 18B.

FIG. 19 shows the dry film resist pattern 50 on the nozzle plate 42 in FIG. 18B. As shown in FIG. 19, the projecting portions 50*a* uprightly project from the nozzles 41 beyond the outside surface of the nozzle plate 42. By controlling the exposing quantity used in FIG. 17D and the developing time used in FIG. 18B, it is possible to obtain a desired shape of the projecting portions 50*a* of the dry film resist pattern 50.

Figure 18C:
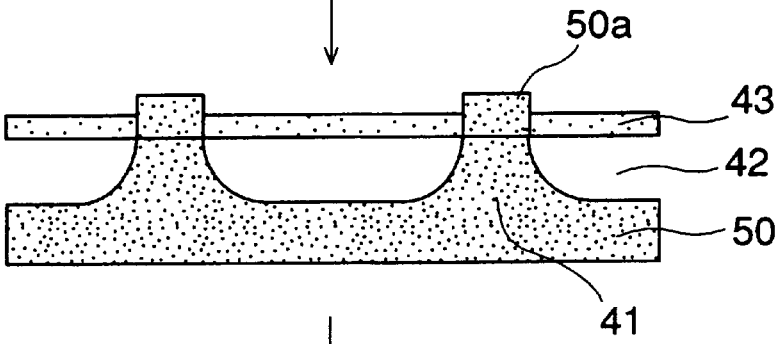

As shown in FIG. 18C, the water-repellent surface treatment is performed so that the surface treatment layer 43 with a desired thickness on the outside surface of the nozzle plate 42 is formed. For example, the nickel and fluorine-containing resin composite electroplating is used to form the surface treatment layer 43. It is necessary that the thickness of the surface treatment layer 43 formed on the nozzle plate 42 is slightly smaller than the thickness of the projecting portions 50*a* on the nozzle plate 42.

Figure 18D:
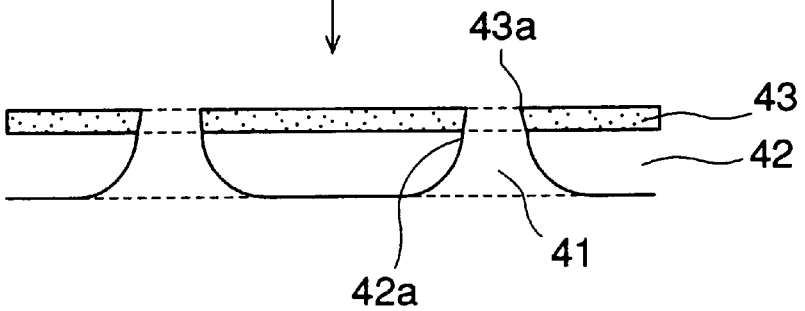

As shown in FIG. 18D, the dry film resist pattern 50 is removed from the surface treated nozzle plate 42. The nozzle plate 42 with the surface treatment layer 42 on the outside surface of the nozzle plate 42 is thus produced.

Figure 20:
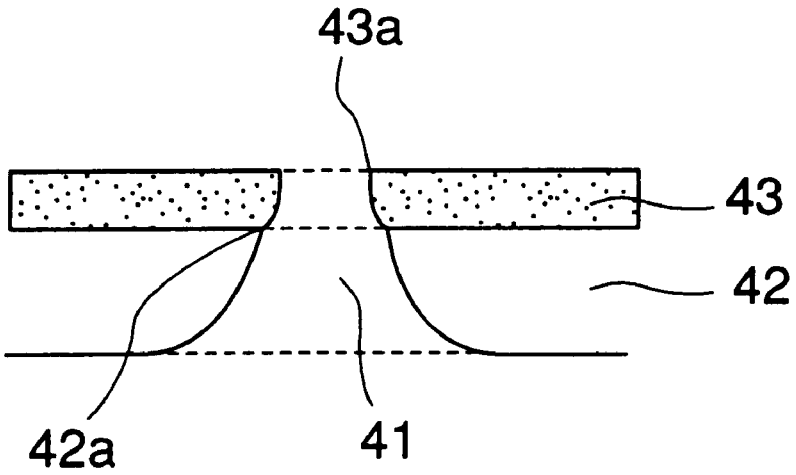
FIG. 20 is an enlarged cross-sectional view of a surface treated nozzle plate in FIG. 18D.

FIG. 20 shows the surface treated nozzle plate 42 produced by the ink jet printing head production method in FIGS. 17A through 18D. As shown, the surface treatment layer 43 on the outside surface of the nozzle plate 42 includes a plurality of openings overlapping the nozzles 41 of the nozzle plate 42, each opening having a second diameter at the peripheral edge 43*a* of the surface treatment layer 43, the second diameter being smaller than the first diameter of each nozzle 41 at the peripheral edge 42*a* of the nozzle plate 42.

In the present embodiment, the dry film resist 45 and the dry film resist 48 are laminated to the inside surface of the nozzle plate 42 and the outside surface thereof. The dry film resist pattern 50 including the projecting portions 50*a* on the nozzle plate 42 is more easily formed. By using the additional dry film resist 48, it is possible to make the thickness of the projecting portions 50*a* on the nozzle plate 42 greater than that of the previous embodiment. Thus, it is possible to form the surface treatment layer 43 with an increased thickness on the outside surface of the nozzle plate 42.

Accordingly, it is possible for the ink jet printing head production method of the present embodiment to easily and efficiently produce an ink jet printing head which provides a stable, constant discharge of ink. In addition, it is possible for the present embodiment to easily and efficiently produce an ink jet printing head having the surface treatment layer with an increased thickness on the nozzle plate.

FIGS. 21A through 22E show an ink jet printing head production method in a further embodiment of the present invention.

Figure 21A:
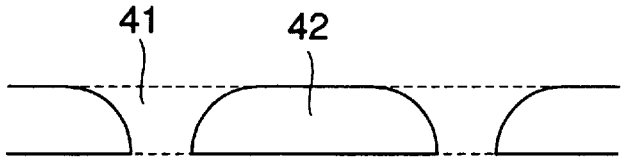
FIGS. 21A through 21F are diagrams for explaining an ink jet printing head production method in a further embodiment of the present invention.

As shown in FIG. 21A, the nozzle plate 42 including the nozzles 41 is prepared through electroforming by using metal such as nickel (Ni).

Figure 21B:
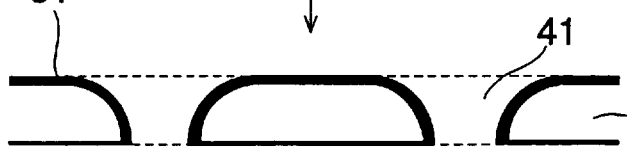

As shown in FIG. 21B, a liquid photosensitive resin 51 is coated to the inside surfaces of the nozzles 41 and the inside surface of the nozzle plate 42. The nozzle plate 42 with the liquid photosensitive resin 51 coated thereon is dried.

Figure 21C:
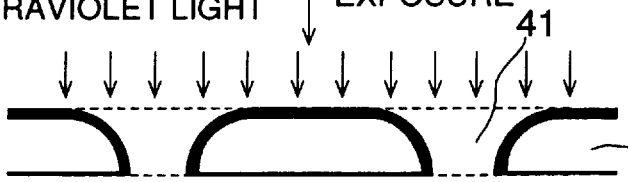

As shown in FIG. 21C, the photosensitive resin 51 on the inside surface of the nozzle plate 42 is exposed to ultraviolet light so that the photosensitive resin 51 is cured.

Figure 21D:
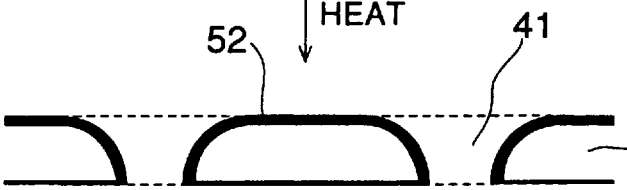

As shown in FIG. 21D, the nozzle plate 42 with the liquid photosensitive resin 51 is heated so that a cured photosensitive resin layer 52 is formed on the inside surface of the nozzle plate 42 and the inside surfaces of the nozzles 41.

Figure 21E:
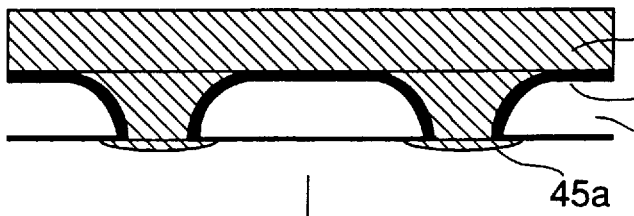

As shown in FIG. 21E, a negative dry film resist 45 is laminated to the inside surface of the nozzle plate 42. As described above, by controlling the laminating temperature and pressure, the dry film resist 45 including a plurality of projecting portions 45*a* is formed. The projecting portions 45*a* project from the nozzles 41 beyond the outside surface of the nozzle plate 42 as shown in FIG. 21E.

Figure 21F:
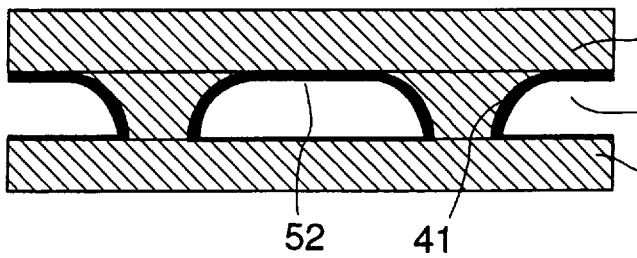

As shown in FIG. 21F, a negative dry film resist 48 is further laminated to the outside surface of the nozzle plate 42. The projecting portions 45*a* of the dry film resist 45 at this time are bonded to the dry film resist 48 without space between the projecting portions 45*a* and the dry film resist 48.

Figures 22A, 22B, 22C, 22D, 22E:
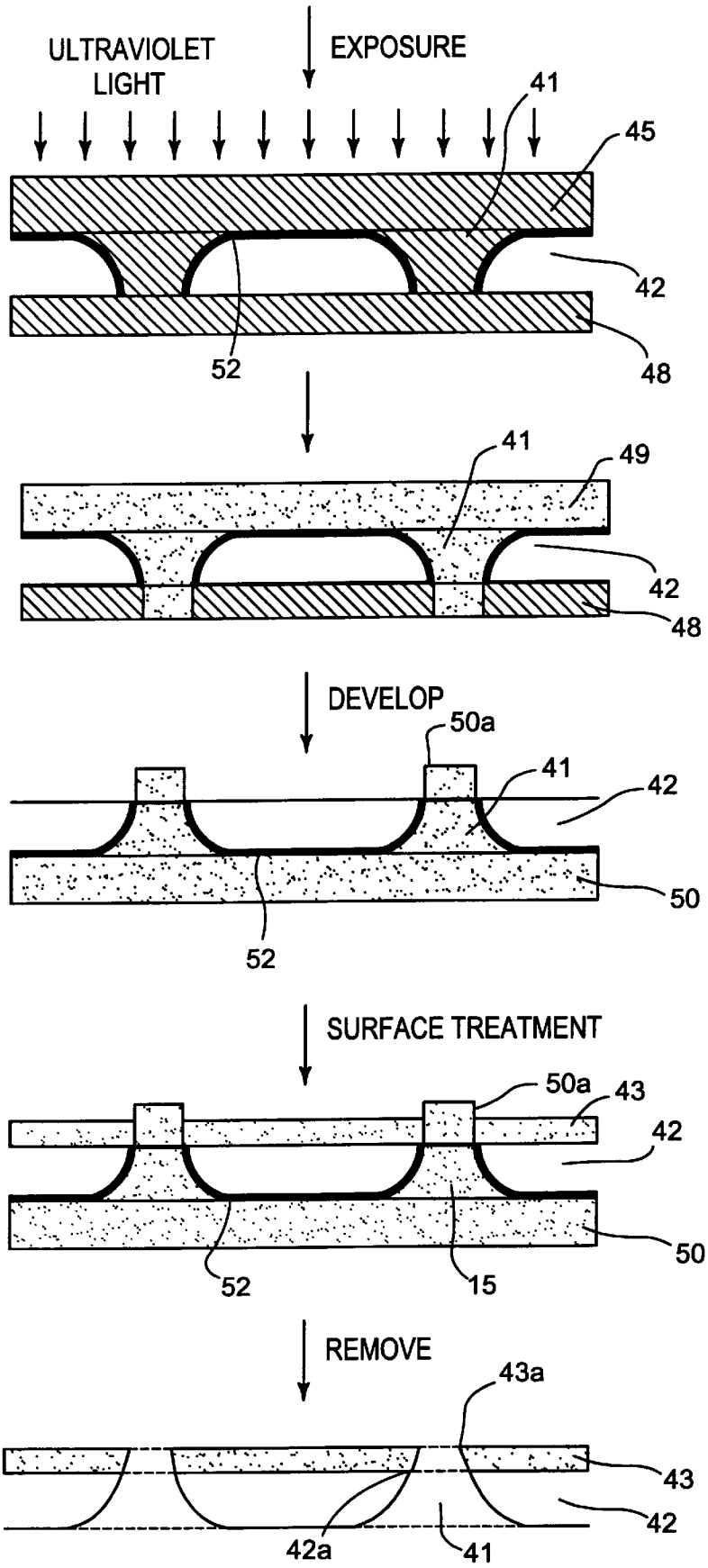
FIGS. 22A through 22E are diagrams for explaining the ink jet printing head production method following the steps in FIGS. 21A through 21F.

As shown in FIG. 22A, the dry film resist 45 on the inside surface of the nozzle plate 42 is exposed to ultraviolet light. The ultraviolet light is applied to the dry film resist 45 on the side of the inside surface of the nozzle plate 42 only. All the areas of the dry film resist 45 and the dry film resist 48 except those concealed by the nozzle plate 42 are exposed to the ultraviolet light.

As shown in FIG. 22B, the dry film resist 45 and the areas of the dry film resist 48 corresponding to the projecting portions 45*a* are cured by the exposure, so that a cured dry film resist 49 including the cured dry film resist 45 and the cured areas of the dry film resist 48 is formed. The other areas of the dry film resist 48 are concealed by the nozzle plate 42, and they are not cured.

As shown in FIG. 22C, the cured dry film resist 49 on the nozzle plate 42 (it is turned upside down in FIG. 22C) is developed so that a dry film resist pattern 50 including a plurality of projecting portions 50*a* corresponding to the cured areas of the dry film resist 48 is formed. The non-cured areas of the dry film resist 48 are removed by the developing.

The projecting portions 50*a* of the dry film resist pattern 50, as shown in FIG. 22C, uprightly project from the nozzles 41 beyond the outside surface of the nozzle plate 42. By controlling the exposing quantity used in FIG. 22A and the developing time used in FIG. 22C, it is possible to obtain a desired shape of the projecting portions 50*a* of the dry film resist pattern 50.

As shown in FIG. 22D, the water-repellent surface treatment is performed so that the surface treatment layer 43 with a desired thickness on the outside surface of the nozzle plate 42 is formed. For example, the nickel and fluorine-containing resin composite electroplating is used to form the surface treatment layer 43. It is necessary that the thickness of the surface treatment layer 43 formed on the nozzle plate 42 is slightly smaller than the thickness of the projecting portions 50*a* on the nozzle plate 42.

As shown in FIG. 22E, the dry film resist pattern 50 and the cured photosensitive resin layer 52 are removed from the surface treated nozzle plate 42. The nozzle plate 42 with the surface treatment layer 42 on the outside surface of the nozzle plate 42 is thus produced.

In the present embodiment, the dry film resist 45 and the dry film resist 48 are laminated to the inside surface of the nozzle plate 42 and the outside surface thereof similarly to the production method in FIGS. 17A through 18D. The present embodiment may be modified so that only the dry film resist 45 is laminated to the inside surface of the nozzle plate 42 similarly to the production method in FIGS. 12A through 12G.

In the present embodiment, the cured photosensitive resin layer 52 on the inside surface of the nozzle plate 42 is formed before the dry film resist 45 is laminated to the nozzle plate 42. The adhesion between the dry film resist 45 and the nozzle plate 42 is increased by the cured photosensitive resin layer 52. Undesired separation of the dry film resist pattern 50 at the peripheral edge 42*a* of the nozzle plate 42 is prevented. Thus, undesired inclusion of the surface treatment layer 43 into the nozzle 42 at the peripheral edge 42*a* of the nozzle plate 42 is prevented.

Figure 23A:
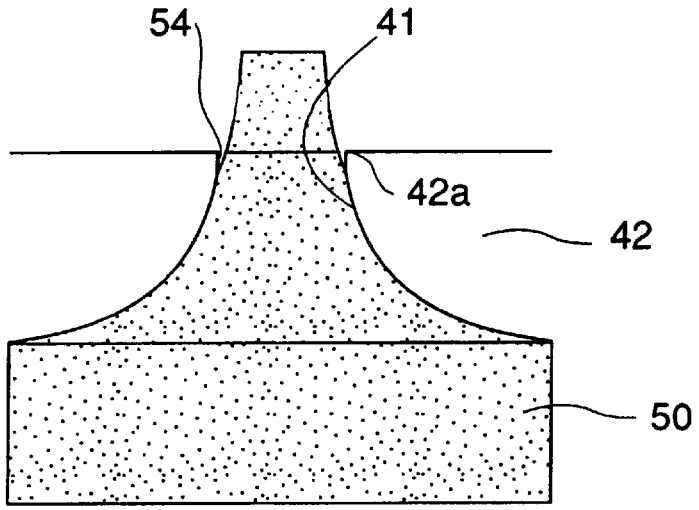
FIGS. 23A and 23B are diagrams for explaining a relationship between the dry film resist pattern and the surface treatment layer.
Figure 23B:
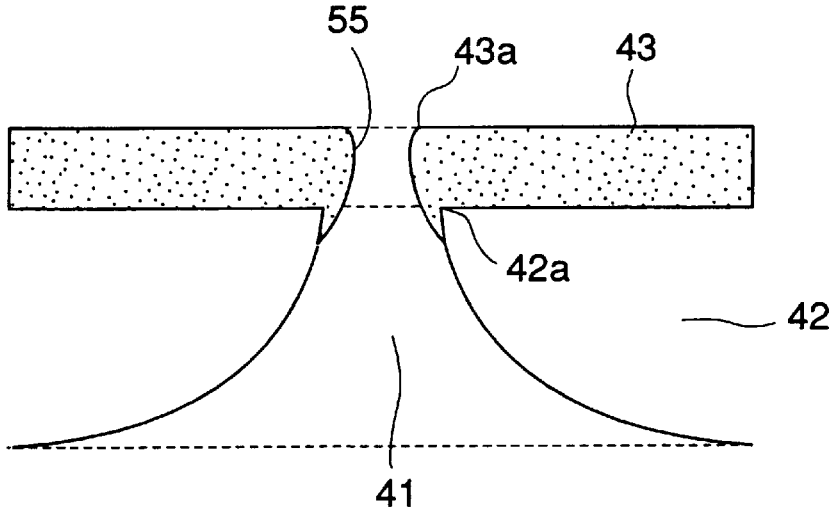

FIGS. 23A and 23B show a relationship between the dry film resist pattern 50 and the surface treatment layer 43. As shown in FIG. 23A, when the dry film resist 45 is exposed to the ultraviolet light and developed, a clearance 54 between the dry film resist pattern 50 and the peripheral edge 42*a* of the nozzle plate 42 may be produced if the exposing quantity is too small and/or the developing time is excessive.

If the clearance 54 is produced, when the surface treatment layer 43 on the outside surface of the nozzle plate 42 is formed, the surface treatment layer 43 may be included into the nozzle 41 at the peripheral edge 42*a* of the nozzle plate. As shown in FIG. 23B, the surface treatment layer 43 in such a case has an included edge 55 at the peripheral edge 42*a* of the nozzle plate 42.

When the ink jet printing head production method of the present embodiment in FIGS. 21A through 22E is performed, the undesired separation of the dry film resist pattern 50 at the peripheral edge 42*a* of the nozzle plate 42 can be prevented. Thus, the undesired inclusion of the surface treatment layer 43 into the nozzle 42 at the peripheral edge 42*a* of the nozzle plate 42 can be prevented.

Accordingly, it is possible for the ink jet printing head production method of the present embodiment to easily and efficiently produce an ink jet printing head for providing a stable, constant discharge of ink. In addition, it is possible for the present embodiment to easily and efficiently produce an ink jet printing head which includes the surface treatment layer having an increased thickness on the nozzle plate and accurate peripheral edges adjacent to the nozzles.

In the present embodiment, the liquid photosensitive resin 51 which is a negative type is coated. However, a liquid photosensitive resin of a positive type may be used instead. In a case in which the positive liquid photosensitive resin is used, even if the photosensitive resin coated at openings of the nozzles 41 remains, the remaining photosensitive resin at the openings of the nozzles 41 may be easily removed by exposing the outside surface to ultraviolet light.

In the present embodiment, the coating of the liquid photosensitive resin 51 to the inside surface of the nozzle plate 42 in FIG. 21B is carried out by using a spinner or a roller coater.

FIGS. 24A through 25F show an ink jet printing head production method in another embodiment of the present invention.

Figure 24A:
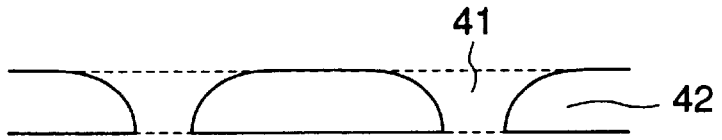
FIGS. 24A through 24F are diagrams for explaining an ink jet printing head production method in another embodiment of the present invention.

As shown in FIG. 24A, the nozzle plate 42 including the nozzles 41 is prepared through electroforming by using metal such as nickel (Ni).

Figure 24B:
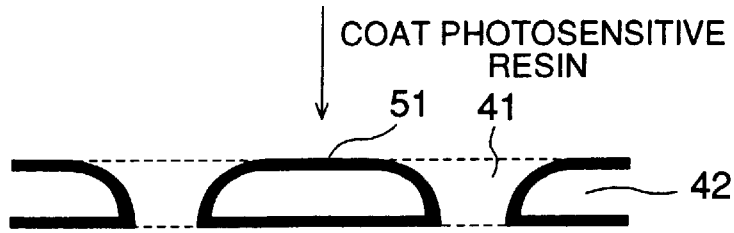

As shown in FIG. 24B, the liquid photosensitive resin 51 is coated to all the surfaces of the nozzle plate 42 including the inside surfaces of the nozzles 41, the inside surface of the nozzle plate 42 and the outside surface thereof. The nozzle plate 42 with the liquid photosensitive resin 51 coated thereon is dried.

Figure 24C:
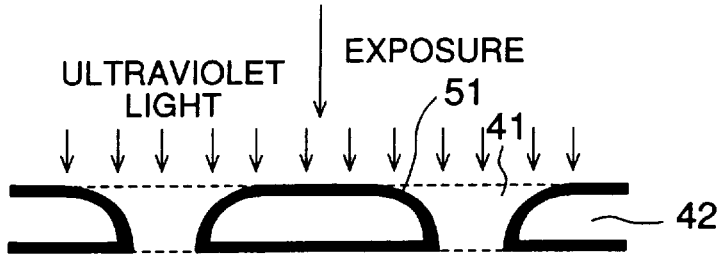

As shown in FIG. 24C, the photosensitive resin 51 on the inside surface of the nozzle plate 42 is exposed to ultraviolet light. The ultraviolet light is applied to only the inside surface of the nozzle plate 42, so that the photosensitive resin 51 on the inside surfaces of the nozzles 41 and on the inside surface of the nozzle plate 42 is cured. The photosensitive resin 51 on the outside surface of the nozzle plate 42 is concealed by the nozzle plate 42, and it is not cured.

Figure 24D:
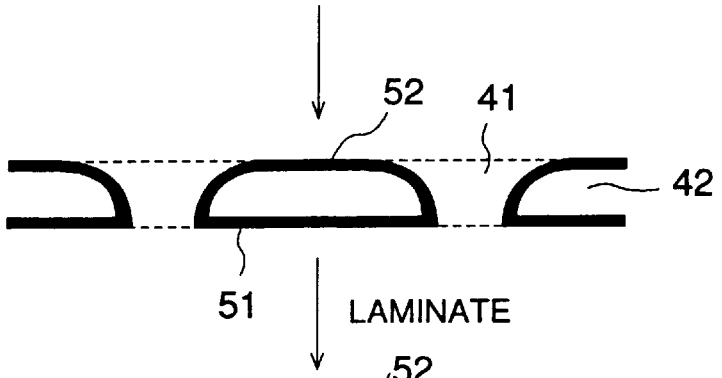

As shown in FIG. 24D, the cured photosensitive resin layer 52 on the inside surface of the nozzle plate 42 and the inside surfaces of the nozzles 41 is formed, and the photosensitive resin 51 on the outside surface of the nozzle plate 42 remains non-cured.

Figure 24E:
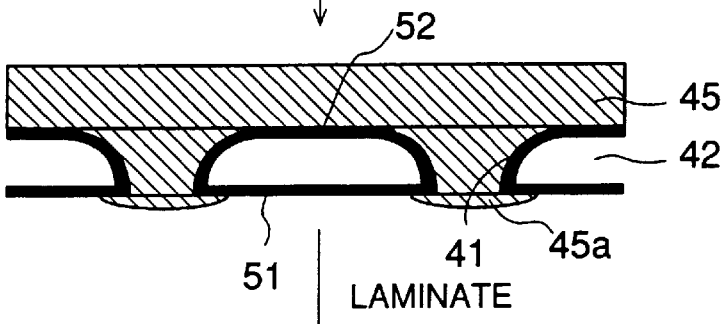

As shown in FIG. 24E, the negative dry film resist 45 is laminated to the inside surface of the nozzle plate 42. As described above, by controlling the laminating temperature and pressure, the dry film resist 45 including the projecting portions 45*a* is formed. The projecting portions 45*a* project from the nozzles 41 beyond the outside surface of the nozzle plate 42 as shown in FIG. 24E.

Figure 24F:
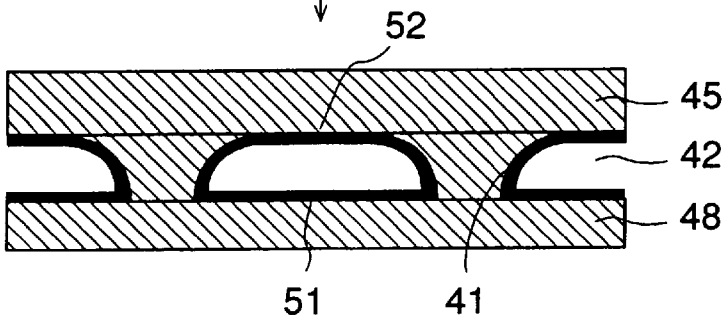

As shown in FIG. 24F, the negative dry film resist 48 is further laminated to the outside surface of the nozzle plate 42. The projecting portions 45*a* of the dry film resist 45 at this time are bonded to the dry film resist 48 without space between the projecting portions 45*a* and the dry film resist 48.

Figures 25A, 25B, 25C, 25D, 25E, 25F:
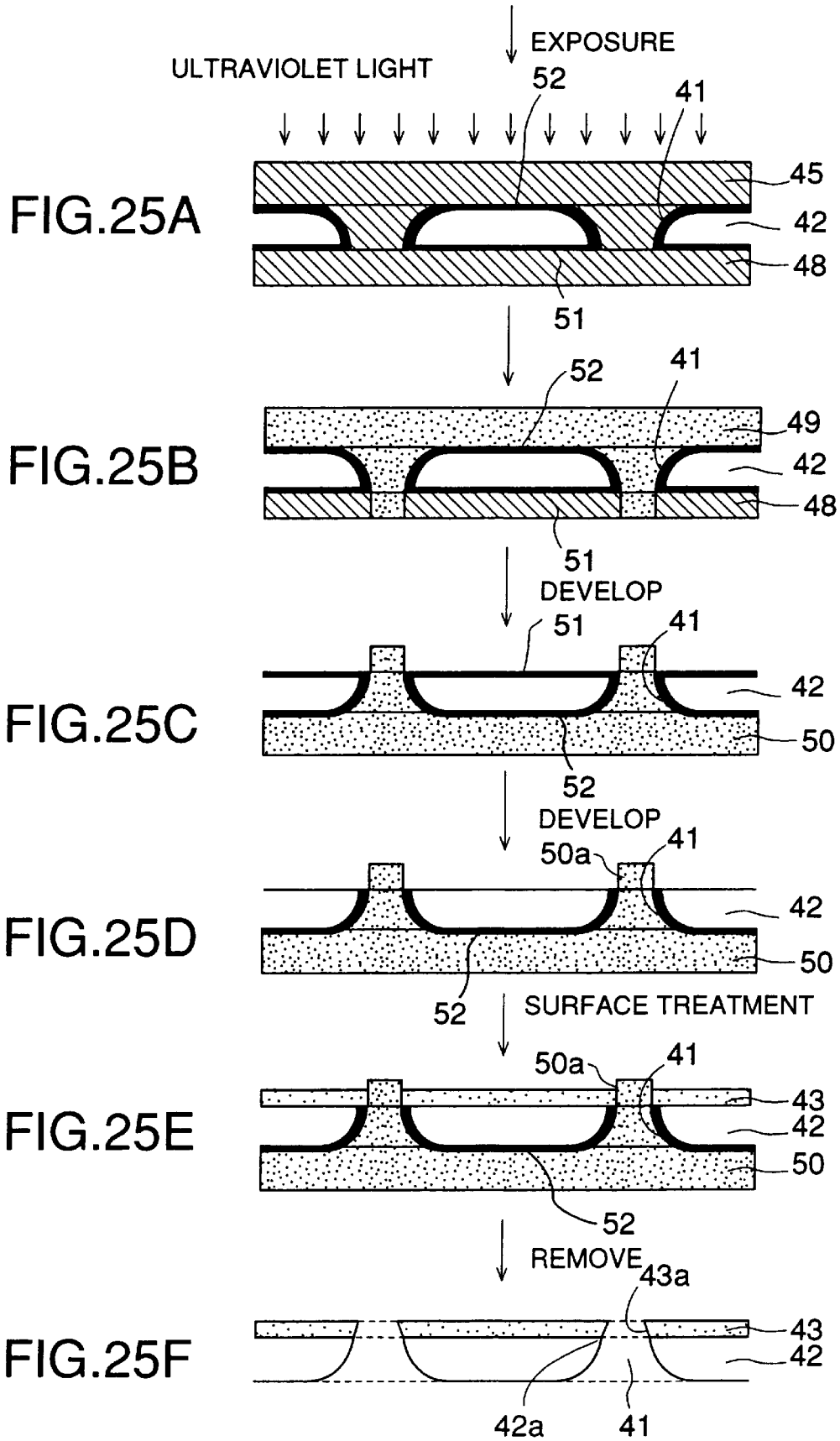
FIGS. 25A through 25F are diagrams for explaining the ink jet printing head production method following the steps in FIGS. 24A through 24F.

As shown in FIG. 25A, the dry film resist 45 on the inside surface of the nozzle plate 42 is exposed to ultraviolet light. The ultraviolet light is applied to the dry film resist 45 on the side of the inside surface of the nozzle plate 42 only. All the areas of the dry film resist 45 and the dry film resist 48 except those concealed by the nozzle plate 42 are exposed to the ultraviolet light.

As shown in FIG. 25B, the dry film resist 45 and the areas of the dry film resist 48 corresponding to the projecting portions 45*a* are cured by the exposure, so that the cured dry film resist 49 including the cured dry film resist 45 and the cured areas of the dry film resist 48 is formed. The other areas of the dry film resist 48 are concealed by the nozzle plate 42, and they are not cured.

As shown in FIG. 25C, the cured dry film resist 49 on the nozzle plate 42 (it is turned upside down in FIG. 25C) is developed so that the dry film resist pattern 50 including the projecting portions 50*a* corresponding to the cured areas of the dry film resist 48 is formed. The non-cured areas of the dry film resist 48 are removed by the developing.

The projecting portions 50*a* of the dry film resist pattern 50, as shown in FIG. 25C, uprightly project from the nozzles 41 beyond the outside surface of the nozzle plate 42. By controlling the exposing quantity used in FIG. 25A and the developing time used in FIG. 25C, it is possible to obtain a desired shape of the projecting portions 50*a* of the dry film resist pattern 50.

As shown in FIG. 25D, the non-cured photosensitive resin 51 on the outside surface of the nozzle plate 42 is developed, and it is removed from the nozzle plate 42 by the developing.

As shown in FIG. 25E, the water-repellent surface treatment is performed so that the surface treatment layer 43 with a desired thickness on the outside surface of the nozzle plate 42 is formed.

As shown in FIG. 25F, the dry film resist pattern 50 and the cured photosensitive resin layer 52 are removed from the surface treated nozzle plate 42. The nozzle plate 42 with the surface treatment layer 42 on the outside surface of the nozzle plate 42 is thus produced.

In the present embodiment, the dry film resist 45 and the dry film resist 48 are laminated to the inside surface of the nozzle plate 42 and the outside surface thereof similarly to the production method in FIGS. 17A through 18D. The present embodiment may be modified so that only the dry film resist 45 is laminated to the inside surface of the nozzle plate 42 similarly to the production method in FIGS. 12A through 12G.

In the present embodiment, the cured photosensitive resin layer on all the surfaces of the nozzle plate 42 is formed before the dry film resist 45 is laminated to the nozzle plate 42. The adhesion between the dry film resist 45 and the nozzle plate 42 is further increased by the cured photosensitive resin layer 52. The coating of the liquid photosensitive resin to the nozzle plate 42 can be carried out by using a dip coating method, and the production method is more easily performed. In addition, undesired separation of the dry film resist pattern 50 at the peripheral edge 42*a* of the nozzle plate 42 is prevented. Thus, undesired inclusion of the surface treatment layer 43 into the nozzle 42 at the peripheral edge 42*a* of the nozzle plate 42 is prevented.

Accordingly, it is possible for the ink jet printing head production method of the present embodiment to easily and efficiently produce an ink jet printing head for providing a stable, constant discharge of ink. In addition, it is possible for the present embodiment to easily and efficiently produce an ink jet printing head which includes the surface treatment layer having an increased thickness on the nozzle plate and accurate peripheral edges adjacent to the nozzles.

In the present embodiment, the liquid photosensitive resin 51 which is a negative type is coated. However, a liquid photosensitive resin of a positive type may be used instead. In a case in which the positive liquid photosensitive resin is used, even if the photosensitive resin coated at openings of the nozzles 41 remains, the remaining photosensitive resin at the openings of the nozzles 41 may be easily removed by exposing the outside surface to ultraviolet light.

In the present embodiment, the removal of the non-cured photosensitive resin layer 51 is performed after the dry film resist 48 is laminated. The present embodiment may be modified so that the removal of the non-cured photosensitive resin layer 51 is performed before the dry film resist 48 is laminated.

Further, FIGS. 29A through 30D show a method of producing the above-described ink jet printing head in FIG. 28.

As previously described, in the ink jet printing head of the present embodiment, the nozzle plate 42 has the inside surface of each nozzle 41 which includes the flared portion 42*b* and the generally cylindrical portion 42*c*.

Figure 29A:
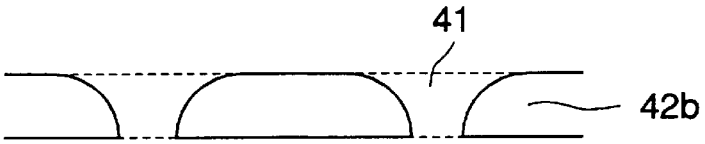
FIGS. 29A through 29F are diagrams for explaining a method of producing the ink jet printing head in FIG. 28.

In FIG. 29A, the flared portion 42*b* of the nozzle plate 42 including the nozzles 41 is prepared through electroforming by using metal such as nickel (Ni).

Figure 29B:
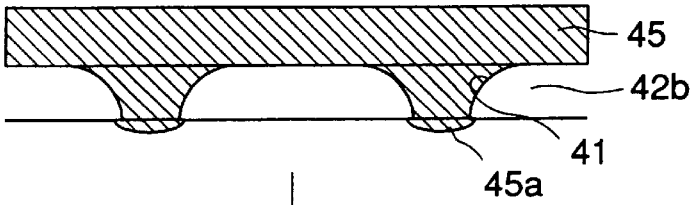

In FIG. 29B, the negative dry film resist 45 is laminated to the inside surface of the flared portion 42*b* of the nozzle plate 42. As described above, by controlling the laminating temperature and pressure, the dry film resist 45 including the projecting portions 45*a* is formed. The projecting portions 45*a* project from the nozzles 41 beyond the outside surface of the nozzle plate 42 as shown in FIG. 29B.

Figure 29C:
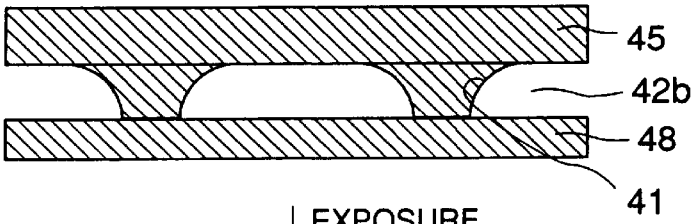

In FIG. 29C, the negative dry film resist 48 is further laminated to the outside surface of the nozzle plate 42 on the side opposite to the flared portion 42*b*. The projecting portions 45*a* of the dry film resist 45 at this time are bonded to the dry film resist 48 without space between the dry film resist 45 and the dry film resist 48.

Figure 29D:
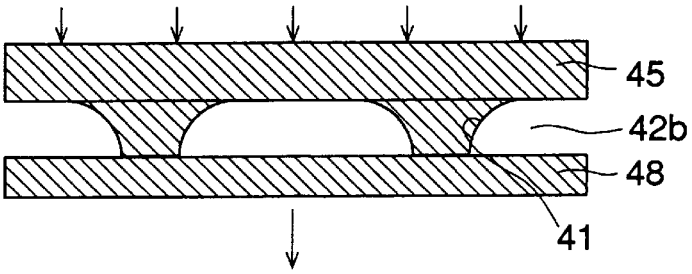

In FIG. 29D, the dry film resist 45 on the inside surface of the nozzle plate 42 is exposed to ultraviolet light. The ultraviolet light is applied to the dry film resist 45 on the side of the flared portion 42*b* of the nozzle plate 42 only. All the areas of the dry film resist 45 and the dry film resist 48 except those concealed by the flared portion 42*b* of the nozzle plate 42 are exposed to the ultraviolet light.

Figure 29E:
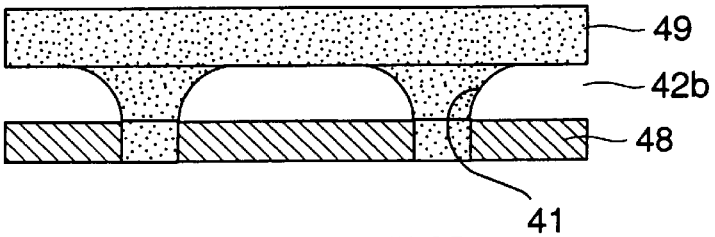

In FIG. 29E, the dry film resist 45 and the areas of the dry film resist 48 corresponding to the projecting portions 45*a* are cured by the exposure, so that the cured dry film resist 49, including the cured dry film resist 45 and the cured areas of the dry film resist 48, is formed. The other areas of the dry film resist 48 are concealed by the nozzle plate 42, and they are not cured.

Figure 29F:
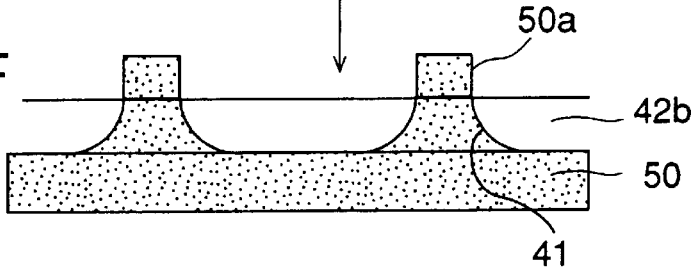

In FIG. 29F, the cured dry film resist 49 on the flared portion 42*b* of the nozzle plate 42 (it is turned upside down in FIG. 29F) is developed so that the dry film resist pattern 50 including the projecting portions 50*a* corresponding to the cured areas of the dry film resist 48 is formed. The non-cured areas of the dry film resist 48 are removed by the developing.

The projecting portions 50*a* of the dry film resist pattern 50, as shown in FIG. 29F, uprightly project from the nozzles 41 beyond the outside surface of the nozzle plate 42. By controlling the exposing quantity used in FIG. 29D and the developing time used in FIG. 29E, it is possible to obtain a desired shape of the projecting portions 50*a* of the dry film resist pattern 50.

Figure 30A:
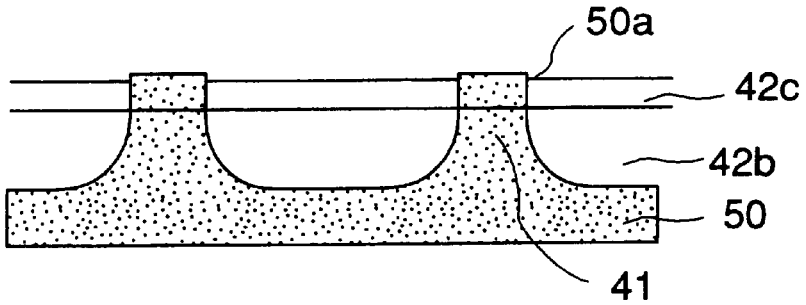
FIGS. 30A through 30D are diagrams for explaining the ink jet printing head production method following the steps in FIGS. 29A through 29F.

In FIG. 30A, electroforming is further performed on the flared portion 42*b* of the nozzle plate 42 by using metal such as nickel (Ni). A plated layer on the flared portion 42*b* of the nozzle plate 42 is prepared by the electroforming at this time, and this plated layer forms the generally cylindrical portion 42*c* adjacent to one of the nozzles 41 in the nozzle plate 42.

Figure 30B:
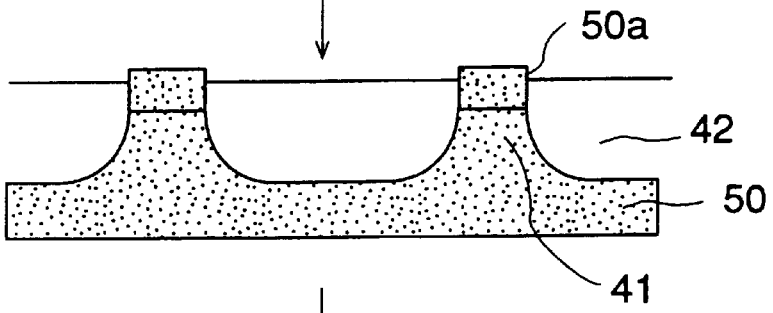

In FIG. 30B, the nozzle plate 42 including the flared portion 42*b* and the generally cylindrical portion 42*c* at the inside surface of each nozzle 41 is formed. The generally cylindrical portion 42*c* is smoothly continuous to one of the openings of a subsequently prepared surface treatment layer 43 at the peripheral edge 42*a* of the nozzle plate 42.

Figure 30C:
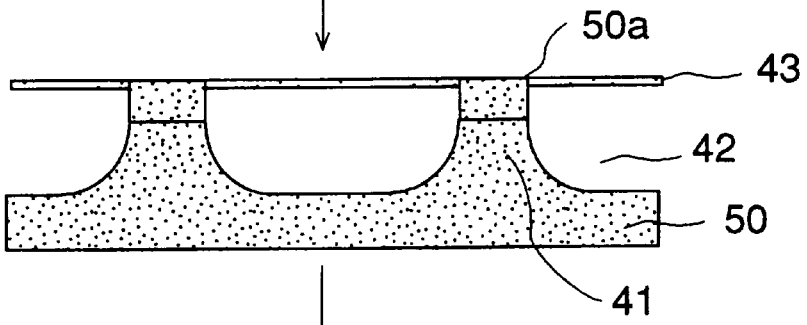

In FIG. 30C, the water-repellent surface treatment is performed so that the surface treatment layer 43 with a desired thickness on the outside surface of the cylindrical portion 42*c* of the nozzle plate 42 is formed.

Figure 30D:
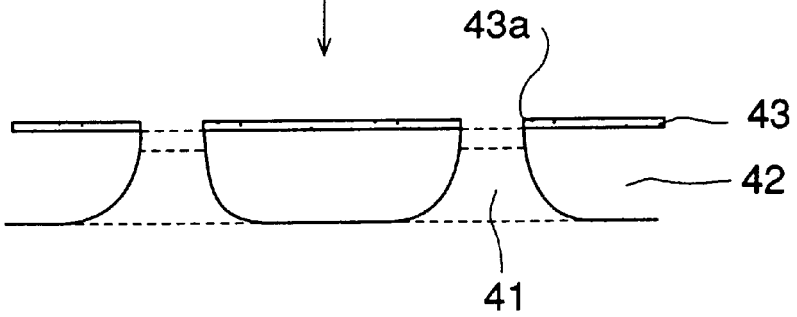

In FIG. 30D, the dry film resist pattern 50 including the projecting portions 50*a* is removed from the surface treated nozzle plate 42. The nozzle plate 42 with the surface treatment layer 43 on the outside surface of the nozzle plate 42 is thus produced. As described above, each nozzle 41 of the nozzle plate 42 includes the inside surface having the flared portion 42*b* and the generally cylindrical portion 42*c* as shown in FIG. 28.

In the present embodiment, the dry film resist 45 and the dry film resist 48 are laminated to the inside surface of the nozzle plate 42 and the outside surface thereof similarly to the production method in FIGS. 17A through 18D. The present embodiment may be modified so that only the dry film resist 45 is laminated to the inside surface of the nozzle plate 42 similarly to the ink jet printing head production method in FIGS. 12A through 12G.

In the present embodiment, after the dry film resist pattern 50 including the projecting portions 50*a* projecting beyond the outside surface of the nozzle plate 42 is formed, the additional electroforming is further performed so that the nozzle plate 42 including the flared portion 42*b* and the generally cylindrical portion 42*c* is prepared. Since the additional electroforming is performed by using the dry film resist pattern 50, it is possible to easily and efficiently produce the ink jet printing head of the present embodiment. In the present embodiment, the diameter of the inside surface of each nozzle 41 in the flared portion 42*b* of the nozzle plate 42 is continuously reduced toward the outside surface of the nozzle plate 42, and the inside surface of each nozzle 41 in the cylindrical portion 42*c* is smoothly continuous to one of the openings of the surface treatment layer 43 at the peripheral edge 42*a* of the nozzle plate 42.

Accordingly, it is possible for the ink jet printing head production method of the present embodiment to easily and efficiently produce an ink jet printing head for providing a stable, constant discharge of ink. In addition, it is possible for the present embodiment to easily and efficiently produce an ink jet printing head which can prevent the lowering of the discharging of ink due to the bubbles staying at the peripheral edge 42*a*, and provide an increased efficiency of the discharging of ink. Therefore, it is possible for the ink jet printing head production method of the present embodiment to easily and efficiently produce an ink jet printing head for providing a stable, constant discharge of ink, thus producing an image with increased picture quality.

Further, in the above-described embodiments, the surface treatment is performed by using the nickel and fluorine-containing resin composite electroplating or the nickel and fluorine-containing resin electroless composite plating. Examples of the composite plating material which is preferably used to form the surface treatment layer 43 are "Metaflon" for composite electroplating and "Nimuflon" for electroless composite plating, both produced by C. Uyemura & Co., Ltd. in Japan.

Other surface treatment procedures which are different from the composite plating may be used to form the surface treatment layer 43. For example, a spray coating procedure using a fluorine-powder-containing coat or any other fluorine-containing compound or silicon-containing compound may be used.

The above-described embodiments are applied to a piezoelectric actuation type ink jet printing head as shown in FIGS. 3 through 5. However, the present invention may be applied to a thermal jet type ink jet printing head which uses a heater as the energy generating part.

Further, the present invention is not limited to the above-described embodiments, and variations and modifications may be made without departing from the scope of the present invention.

What is claimed is:

1. An ink jet printing head comprising:

a nozzle plate having an ink-discharge-side surface and a plurality of nozzles for discharging ink out of the nozzle plate, each nozzle having a first diameter at a peripheral edge of said nozzle plate; and a surface treatment layer provided only on said ink-discharge-side surface of said nozzle plate, said surface treatment layer having:

a plurality of openings overlapping said plurality of nozzles, and a plurality of peripheral edges forming said plurality of openings respectively, each opening having a central axis and a second diameter about the central axis of the opening, said second diameter being smaller than said first diameter, wherein each peripheral edge of the surface treatment layer at each opening extends only toward the central axis of the opening, and has no extension beyond a plain defined by the ink-discharge-side surface of the nozzle plate.

2. The ink jet printing head according to claim 1, wherein said peripheral edge of said surface treatment layer has a straight-line surface adjacent to one of the openings, said straight-line surface being substantially parallel to said ink-discharge-side surface of said nozzle plate.

3. The ink jet printing head according to claim 2, wherein a cross section of each said peripheral edge of said surface treatment layer has a convex curved surface extending from the ink discharge-side surface of the nozzle plate to the peripheral edge forming the opening, the curved surface having a radius that is below 1 $\mu$m.

4. The ink jet printing head according to claim 1, further comprising an ink chamber provided under the nozzle pate at each of the plurality of nozzles, wherein each nozzle of said nozzle plate has an internal surface extending from the peripheral edge of the nozzle plate to the ink chamber, the internal surface including a flared portion extending from the ink chamber toward the ink-discharge-side surface and a generally cylindrical portion extending from said flared portion to the ink-discharge-side surface, said flared portion being formed to have a diameter that is continuously reduced toward the ink-discharge-side surface.

5. The ink jet printing head according to claim 1, wherein said surface treatment layer and said nozzle plate are smoothly continuous to each other at a peripheral edge of each of the nozzles of the nozzle plate.

6. The ink jet printing head according to claim 1, wherein the ratio of the second diameter of each opening of said surface treatment layer to the first diameter of each nozzle of said nozzle plate is larger than 50% and smaller than 100%.

7. The ink jet printing head according to claim 1, wherein said surface treatment layer is liquid-repellent.

8. The ink jet printing head according to claim 7, wherein said surface treatment layer contains nickel, phosphorus, and fluorine-containing resin.

9. The ink jet printing head according to claim 8, wherein the content of said fluorine-containing resin in said surface treatment layer is in the range of 20% to 40% in volume.

10. The ink jet printing head according to claim 7, wherein said surface treatment layer contains nickel and fluorine-containing resin.

11. The ink jet printing head according to claim 10, wherein the content of said fluorine-containing resin in said surface treatment layer is in the range of 20% to 40% in volume.

12. The ink jet printing head according to claim 1, wherein said nozzle plate has a hydrophilic surface.

13. The ink jet printing head according to claim 1, wherein a cross section of said surface treatment layer has a thickness that is in a range of 1 $\mu$m to 10 $\mu$m.

* * * * *